US009640908B2

(12) United States Patent
Mizrahi et al.

(10) Patent No.: US 9,640,908 B2
(45) Date of Patent: May 2, 2017

(54) ALIGNMENT APPARATUS AND A METHOD FOR MANUFACTURING THEREOF

(71) Applicant: Mizco International Inc., Avenel, NJ (US)

(72) Inventors: Maurice Mizrahi, Brooklyn, NY (US); Mark Andersen, Brooklyn, NY (US); David Goetz, Brooklyn, NY (US)

(73) Assignee: MIZCO INTERNATIONAL INC., Avenel, NJ (US)

( * ) Notice: Subject to any disclaimer, the term of this patent is extended or adjusted under 35 U.S.C. 154(b) by 0 days.

(21) Appl. No.: 14/988,261

(22) Filed: Jan. 5, 2016

(65) Prior Publication Data

US 2016/0197439 A1 Jul. 7, 2016

Related U.S. Application Data

(60) Provisional application No. 62/099,964, filed on Jan. 5, 2015.

(51) Int. Cl.
*H01R 13/629* (2006.01)
*H01R 13/631* (2006.01)

(52) U.S. Cl.
CPC ..... *H01R 13/629* (2013.01); *H01R 13/6315* (2013.01)

(58) Field of Classification Search
CPC .. H01R 13/629; H01R 13/6315; H01R 12/88; H01R 35/00; H01R 35/04
USPC ..... 439/162, 164, 165, 246, 341
See application file for complete search history.

(56) References Cited

U.S. PATENT DOCUMENTS 2,369,860 A * 2/1945 Schroeder ..... B61G 5/10 439/133
3,094,364 A * 6/1963 Liagg ..... H01R 13/629 285/154.1
3,617,985 A * 11/1971 Kehl ..... H01R 23/10 439/341

(Continued)

FOREIGN PATENT DOCUMENTS

DE EP 1249895 A2 * 10/2002 ..... H01R 13/6315
FR 2818450 A1 6/2002

(Continued)

OTHER PUBLICATIONS

International Search Report and Written Opinion for PCT/US16/12190 dated Apr. 28, 2016; 12 pages.

*Primary Examiner* — Tulsidas C Patel
*Assistant Examiner* — Travis Chambers
(74) *Attorney, Agent, or Firm* — Loza & Loza, LLP; Jeffrey T. Burgess

(57) ABSTRACT

An alignment apparatus is coupled to an accessory module that is rotatably attachable to an electronic device. The alignment apparatus includes a pivot mounting member and a connector retaining member movably coupled to the pivot mounting member. The connector retaining member is rigidly coupled to a connector. The connector retaining member moves the connector with respect to the pivot mounting member to a predetermined angle. The predetermined angle aligns the connector with a connecting mate on the electronic device in an approximately parallel position while the accessory module is rotating for attachment onto the electronic device.

17 Claims, 14 Drawing Sheets

(56) References Cited

U.S. PATENT DOCUMENTS 3,668,605 A * 6/1972 Albert ..... H01R 13/62933 361/740
3,728,664 A * 4/1973 Hurst ..... H04M 1/0262 439/341
3,969,796 A * 7/1976 Hodsdon ..... H01M 2/1022 24/270
5,302,136 A * 4/1994 St. Germain ..... H01R 13/631 439/341
5,306,174 A * 4/1994 Kiga ..... H01R 13/639 348/E5.026
5,556,286 A * 9/1996 Ikesugi ..... H01R 12/716 439/247
5,666,264 A * 9/1997 Chandler ..... H05K 7/1481 361/679.6
6,064,195 A * 5/2000 Clayton ..... G01R 1/06705 324/750.16
6,083,027 A * 7/2000 Sato ..... H01R 13/62933 439/341
6,558,177 B2 * 5/2003 Havener ..... H01R 24/50 439/246
6,676,430 B1 * 1/2004 Conorich ..... H01R 13/6272 439/341
6,910,911 B2 * 6/2005 Mellott ..... H01R 13/2421 439/180
7,303,420 B2 * 12/2007 Huch ..... H01R 35/04 439/341
7,442,064 B2 * 10/2008 Miwa ..... H01R 43/26 439/326
8,113,873 B1 * 2/2012 Sarraf ..... H01R 13/6315 439/533
8,167,624 B2 * 5/2012 Hartlef ..... H01R 13/6315 439/39
8,360,795 B2 * 1/2013 Moore ..... H01R 13/6392 439/342
8,801,459 B2 * 8/2014 Mrowka ..... H01R 24/54 439/246
8,821,173 B2 * 9/2014 Carnevali ..... G06F 1/1632 361/679.41
2004/0229490 A1 * 11/2004 Bernat ..... H01R 13/6315 439/246
2010/0210129 A1 * 8/2010 Arts ..... H01R 13/748 439/248

FOREIGN PATENT DOCUMENTS

GB 1198775 A 7/1970
JP 2004047188 A 2/2004

* cited by examiner

ALIGNMENT APPARATUS AND A METHOD FOR MANUFACTURING THEREOF

CROSS REFERENCE TO RELATED APPLICATIONS

The present application claims priority under 35 U.S.C. §119 to U.S. Provisional Application No. 62/099,964 entitled, "Alignment Apparatus," filed Jan. 5, 2015, and expressly incorporated by reference herein.

BACKGROUND

Field

The present disclosure relates to an apparatus for aligning connectors, and more particularly for aligning connectors of two bodies together for accurate engagement.

Description of Related Art

Portable consumer electronic devices are becoming more popular and prevalent in use. For example, portable action video cameras are very popular with active athletes and are routinely used to capture sporting activities. These portable video cameras are compact and can be mounted in various places such as helmets, drones, skis, snowboards, surfboards, bikes, etc. Because of the compact size of such cameras, the battery size is often smaller which leads to shorter duration of the battery charge and shorter usage times. One solution is to carry extra battery packs. However, most available battery packs are difficult to install because the power connecting mechanisms are poorly designed and hard to connect during installation.

Another popular accessory for portable cameras is a wireless module that enables the electronic device to wirelessly communicate using a WLAN, Bluetooth, cellular or other type of wireless protocol. For example, the wireless module enables the electronic device to wirelessly communicate files to a central server or other device. However, again the wireless module is often difficult to install due to poorly designed data connecting mechanisms. For example, the data connecting mechanism may include an input/output (I/O) port, such as a 30 pin connector port, a USB port, an HDMI port, etc. The I/O port must be aligned while installing the wireless module. This alignment may be difficult especially when the wireless module or battery module is rotatably connected to the electronic device. A similar issue exists for most accessory modules, wherein the connecting mechanism for the I/O interface is poorly designed and as such is hard to install and use.

Moreover, this problem exists with other electronic devices besides portable video cameras. For example, it is often difficult to install or detach accessories or battery modules for laptops, smart tablets, etc.

Accordingly, what is needed is an improved mechanism that allows for easier installation and improved connectivity of battery modules and accessories to electronic devices, such as cameras, laptops, smart tablets, etc.

BRIEF SUMMARY

The following presents a simplified summary in order to provide a basic understanding of some embodiments. This summary is not an extensive overview and is not intended to identify key or essential elements or delineate the scope of the embodiments herein.

According to one aspect, an accessory module includes a rotating attachment configured to rotatably attach the accessory module to an electronic device and an alignment apparatus. The alignment apparatus includes a pivot mounting member rigidly coupled to the accessory module; a connector; and a connector retaining member including a connector. The connector retaining member is slidably coupled to the pivot mounting member and is configured to move the connector with respect to the pivot mounting member to a predetermined angle that aligns the connector in an approximately parallel position with respect to a connecting mate coupled to the electronic device.

In another aspect, the connector retaining member forms one or more slots and one or more tabs are fixedly attached to the pivot mounting member and secured in the one or more slots.

In another aspect, a retainer member is coupled to the pivot mounting member and to the one or more tabs. The connector retaining member is configured to rotate and slide with respect to the pivot mounting member along the one or more slots guided by the one or more tabs and the retainer member.

In another aspect, at least one of the one or more slots includes a curved shape such that the connector retaining member is configured to slide and rotate along the at least one slot with respect to the pivot mounting member to maintain the connector in an approximately parallel position with the connecting mate as the accessory module rotates with respect to the electronic device.

In another aspect, the connector retaining member is configured to move the connector with respect to the pivot mounting member to the predetermined angle when the accessory module rotates to a predetermined angle of rotation with respect to the electronic device.

In another aspect, the connector retaining member is configured to rotate and slide along the slots to maintain the connector in an approximately parallel position with respect to the connecting mate as the accessory module rotates between the predetermined angle of rotation and full engagement with the electronic device.

In another aspect, the predetermined angle and the predetermined angle of rotation are approximately equivalent. For example, both the predetermined angle and the predetermined angle of rotation are approximately 11 degrees. In another example, the predetermined angle is in a range of approximately 6 degrees to 16 degrees, and the predetermined angle of rotation is in a range of approximately 6 degrees to 16 degrees. In another embodiment, the predetermined angle and the predetermined angle of rotation are within approximately 1 to 2 degrees. For example, when the predetermined angle of rotation is 11 degrees, the predetermined angle is in a range of approximately 10 to 12 degrees or in a range of approximately 9 to 13 degrees.

In another aspect, the predetermined angle of rotation includes at least one of: an angle wherein the connector and the connecting mate are initially contacting or an angle wherein the connector and the connecting mate are prior to contacting.

In another aspect, a spring element is coupled to the pivot mounting member and the connector retaining member. The spring element is configured to move the connector retaining member to the predetermined angle with respect to the pivot mounting member.

BRIEF DESCRIPTION OF THE DRAWINGS

Some embodiments of the apparatus and/or methods in accordance with embodiments of the disclosure are now described, by way of example only, and with reference to the accompanying drawings, in which like reference numerals identify similar components throughout.

DETAILED DESCRIPTION

In the following detailed description, only certain exemplary embodiments of are shown and described, by way of illustration. As those skilled in the art would recognize, the disclosed embodiments may be implemented in many different forms and should not be construed as being limited to the embodiments set forth herein. The description and drawings merely illustrate the principles of various embodiments. It will thus be appreciated that those skilled in the art will be able to devise various arrangements that, although not explicitly described or shown herein, embody the principles herein and in the claims and fall within the spirit and scope of the disclosure. Furthermore, all examples recited herein are principally intended expressly to be only for pedagogical purposes to aid the reader in understanding the principles of the embodiments, and are to be construed as being without limitation to such specifically recited examples and conditions.

Moreover, all statements herein reciting principles, aspects, and embodiments, as well as specific examples thereof, are intended to encompass equivalents thereof. Specific details are given to provide a thorough understanding of the various aspects of the disclosure. However, it will be understood by one of ordinary skill in the art that the aspects may be practiced without these specific details. The word "exemplary" or "embodiment" or "aspect" is used herein to mean "serving as an example, instance, or illustration." Any implementation described herein as "exemplary" or as an "embodiment" or as an "aspect" is not necessarily to be construed as preferred or advantageous over other descriptions of implementations in the disclosure. Likewise, the term "exemplary" or "embodiment" or "aspect" does not require that all implementations include the described feature, advantage or mode of operation.

Overview

An accessory module couples to an electronic device by a rotating attachment. The accessory module includes an alignment apparatus having a pivot mounting member that is rigidly mounted directly or indirectly onto the accessory module. A connector retaining member is movably coupled either directly or indirectly to the pivot mounting member. The connector retaining member is fixedly coupled to a connector and moves the connector to a predetermined angle with respect to the pivot mounting member. The predetermined angle positions the connector approximately parallel to a connecting mate on the electronic device while the accessory module is rotated with respect to the electronic device for attachment. The alignment apparatus thus enables a parallel insertion of the connector with the connecting mate as the accessory module rotates for installation onto the electronic device.

Embodiments

Figure 1A:
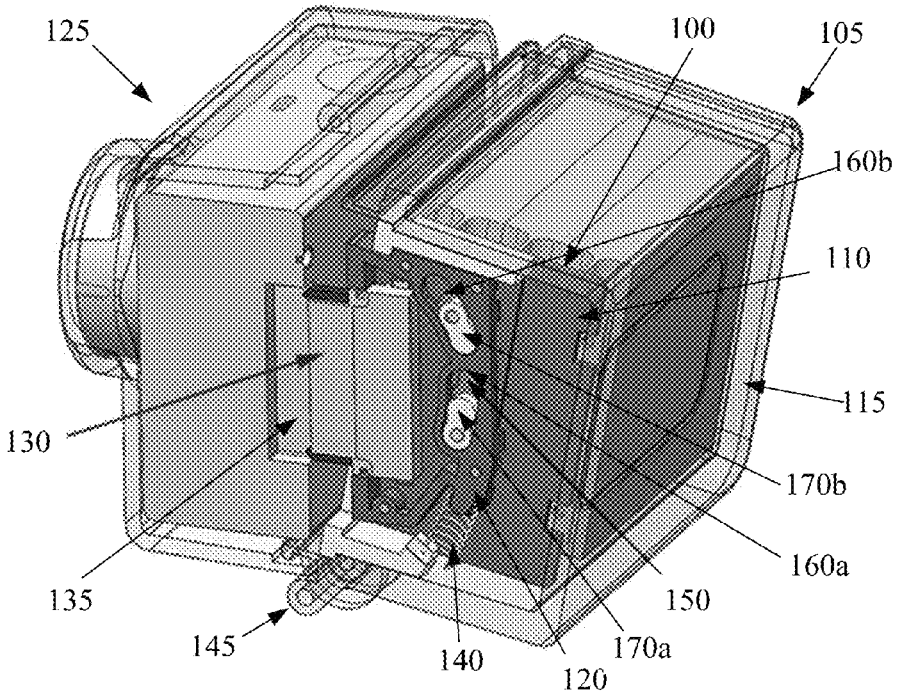
FIG. 1A illustrates an elevational view of an exemplary embodiment of an accessory module with an alignment apparatus in an opened or partially opened position.
Figure 1B:
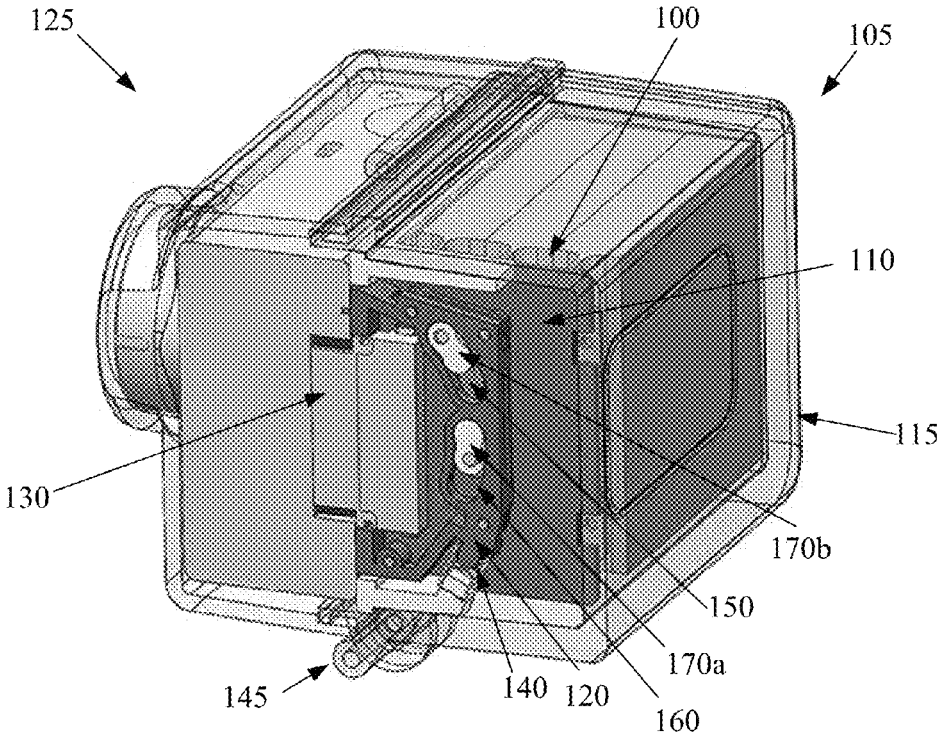
FIG. 1B illustrates an elevational view of an exemplary embodiment of the accessory module with the alignment apparatus in a closed position.

FIG. 1A illustrates an exemplary embodiment of an accessory module 105 with an alignment apparatus 100 in an open or partially open position, and FIG. 1B illustrates an exemplary embodiment of the accessory module 105 with the alignment apparatus 100 in a closed position. With respect to FIG. 1A, the accessory module 105 includes a housing 115 that is rotatably attachable to an electronic device 125 by a rotating attachment 145. In the shown embodiment, the rotating attachment 145 is positioned on a bottom surface of the accessory module 105 though the rotating attachment 145 may also be positioned on a top or side surface of the accessory module 105. The rotating attachment 145 may include any type of movable joint wherein the accessory module 105 rotates or pivots or swivels. For example, the rotating attachment may include a hinge, t-hinge, gate hinge, strap hinge, or another type of hinge, ball/socket joint or other movable joint.

In an embodiment, the electronic device 125 is a consumer device. For example, the electronic device 125 may include a portable action video camera, such as a GoPro® camera, or other type of camera. The electronic device 125 may also include a laptop, smart tablet, printer, smart phone, etc. The accessory module 105 may include a battery module, wireless module or other component for the electronic device 135. In other embodiments, the electronic device 125 and accessory module 105 may be components of a single device, such as a laptop screen and base of a foldable laptop computer.

In an embodiment, a connector 130 of the accessory module 105 couples or engages with a connecting mate 135 of the electronic device 125. Connector 130 may include for example a male or female connector for a data port, such as a High Definition Multimedia Interface (HDMI) port, a USB port, digital visual interface (DVI) port, a video graphic array (VGA), RJ45 port, phone connector port, 30 pin connector port or other types of ports for communicating data. In addition or alternatively, the connector 130 may include a male or female connector for a power port, such as a USB port, an IEEE 802.3af Power over Ethernet (PoE) port, a MIDI port, 30 pin connector port or other types of ports operable to supply power. The connecting mate 135 includes a counterpart male or female connector for the data and/or power port of the connector 130.

In prior systems, the connector 130 is rigidly attached to the housing 115 of the accessory module 105. Thus, in these prior systems, it is difficult to properly align the connector 130 to the connector mate 135 as the accessory module 110 rotates for attachment to the electronic device 125.

In one or more embodiments herein, the connector 130 is moveably coupled to the housing 115 by the alignment apparatus 100 to properly align the connector 130 in a parallel position to the connecting mate 135 during a rotating attachment of the accessory module 105. The alignment apparatus 100 includes a pivot mounting member 110, a connector retaining member 120, a spring element 140, and a retainer member 150. The pivot mounting member 110 is rigidly mounted directly or indirectly onto the accessory module 105. When the outer housing 115 pivots or rotates to attach to the electronic device 125, pivot mounting member 110 also pivots or rotates at the same degree or magnitude.

In order to align the connector 130 with the connecting mate 135, the connector retaining member 120 is movably coupled either directly or indirectly to the pivot mounting member 110. The connector retaining member 120 is fixedly attached to the connector 130. The connector retaining member 120 moves the connector with respect to the pivot mounting member to a predetermined angle. The predetermined angle positions or aligns the connector 130 in an approximately parallel position with respect to the connecting mate 135.

For example, when the outer housing 115 is pivotably rotated through a predetermined angle of rotation, the connector 130 and the connecting mate 135 are aligned in an approximately parallel position. In one aspect, this predetermined angle of rotation is configured at a point in the rotation wherein the connector 130 and the connecting mate 135 are close to contacting or are initially contacting. The connector 130 may thus be engagably aligned with connecting mate 135 in an approximately parallel position to the connector mate 135 as the accessory module 105 rotates for attachment to the electronic device 125. The connector 130 is thus more easily attached to the connector mate 135.

To moveably couple the connector retaining member 120 to the pivot mounting member 110, one or more slots 160 are formed in the connector retaining member 120. FIG. 1A illustrates two slots 160*a* and 160*b* though one slot or more than two slots may be implemented as well. A retainer member 150 is coupled to the pivot mounting member 110 and to one or more tabs 170*a* and 170*b*, wherein at least one tab 170 is secured within each slot 160. The retainer member 150 and the tabs 170 are rigidly attached to the pivot mounting member 110. The connector retaining member 120 is configured to rotate and slide with respect to the pivot mounting member 110 along the slots 160 guided by the tabs 170 and the retainer member 150.

A spring 140 is coupled between the pivot mounting member 110 and the connector retaining member 120. The spring 140 exerts pressure against the connector retaining member 120 to move the connector retaining member 120 along the slots 160 to an open position. In an embodiment, the slots 160 include a curved shape to guide the connector retaining member 120 such that the connector 130 maintains a parallel position with respect to the connecting mate 135 as the accessory module 105 rotates and engages with the electronic device 125.

As the accessory module 105 continues to rotate, the connector 130 engages with the connecting mate 135 such that pressure is applied to the connector 130 and the connector retaining member 120. This pressure on the connector retaining member 120 compresses spring element 140 of the alignment apparatus 100 and forces the connector retaining member 120 to move into a closed position.

FIG. 1B illustrates the accessory module 105 with the alignment apparatus 100 in the closed position. The accessory module 105 has completed its rotation with respect to the electronic device 125 and is attached to the electronic device 125 with the connector 130 fully engaged to connector mate 135. The connector retaining member 120 has retracted into the alignment apparatus 100 and is in a closed position with respect to the pivot mounting member 110.

The alignment apparatus 100 thus enables a parallel insertion of connector 130 with connecting mate 135 during a rotating attachment of the accessory module 105. The housing 115 of the accessory module 105 may rotate for attachment to the electronic device 125 while the connector 130 remains approximately parallel with the connector mate 135. This alignment helps to more easily connect and attach the connector 130 to the connecting mate 135, and as well, attach the accessory module 105 to the electronic device 125.

Figure 2:
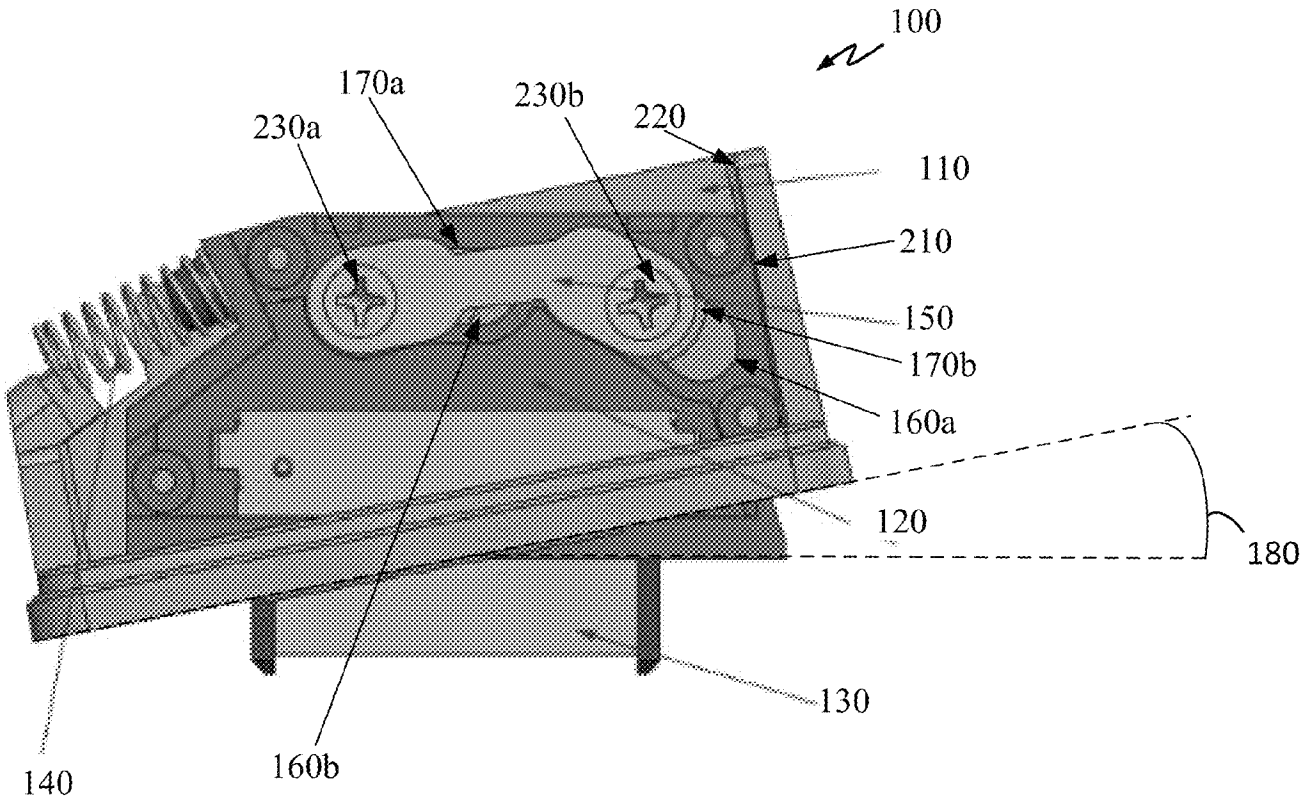
FIG. 2 illustrates a side view of an exemplary embodiment of the alignment apparatus.

FIG. 2 illustrates a side view of an exemplary embodiment of the alignment apparatus 100 in more detail. In an embodiment, the connector retaining member 120 is slidably coupled to the pivot mounting member 110 using the one or more slots 160 and the retainer member 150 and tabs 170. In one aspect, connector retaining member 120 forms at least one slot 160. In another aspect, connector retaining member 120 forms two or more slots 160.

At least one of the one or more tabs 170*a* and 170*b* is positioned within each slot 160*a* and 160*b*. The tabs 170 are fixedly attached by attachment devices 230*a* and 230*b* to the retainer member 150 and to the pivot mounting member 110. In one aspect, the tabs 170 may include one or more sides including grooves. The grooved sides of the tabs 170 engage with sides of the one or more slots 160 to secure the tabs 170 within the slots 160. The connector retaining member 120 is thus moveably coupled by the tabs 170 and the retainer member 150 to slide and rotate along the slots 160 with respect to the pivot mounting member 110. The connector 130 is fixedly attached to the connector retaining member 120 and so also slides and rotates with respect to the pivot mounting member 110.

In an embodiment, the retainer member 150 is adjacent to a first surface of the connector retaining member 120, and the pivot mounting member 110 is adjacent to a second, opposite surface of the connector retaining member 120. The one or more tabs 170*a* and 170*b* within each slot 160*a* and 160*b* are fixedly attached by attachment devices 230*a* and 230*b* to the retainer member 150 and to the pivot mounting member 110 through the one or more slots 160. At least one slot 160 has a curved shape and a size to guide the connector retaining member 120 to slide and rotate to at least a predetermined angle 180 with respect to the pivot mounting member 110. This predetermined angle 180 is selected to align the connector 130 to the connecting mate 135 in an approximately parallel position when the accessory module 105 rotates and approaches the electronic device 125.

In one exemplary embodiment, the one or more slots 160 are precisely shaped such that the predetermined angle 180 between the connector retaining member 120 and the pivot mounting member 110 is approximately 11 degrees. In another exemplary embodiment, the predetermined angle 180 has a range of approximately 6 degrees to 16 degrees. The predetermined angle 180 may be adjusted to other values and ranges depending on the specific dimensional details and geometry of the electronic device 125 and the accessory module 105.

Figure 3A:
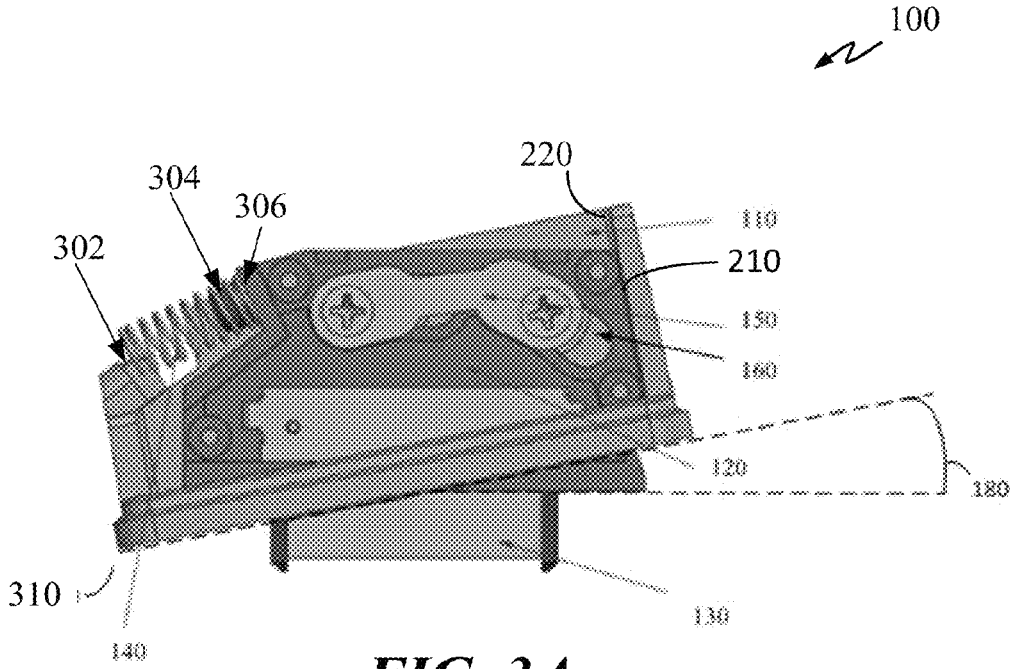
FIG. 3A illustrates a side view of an exemplary embodiment of the alignment apparatus in an open position.
Figure 3B:
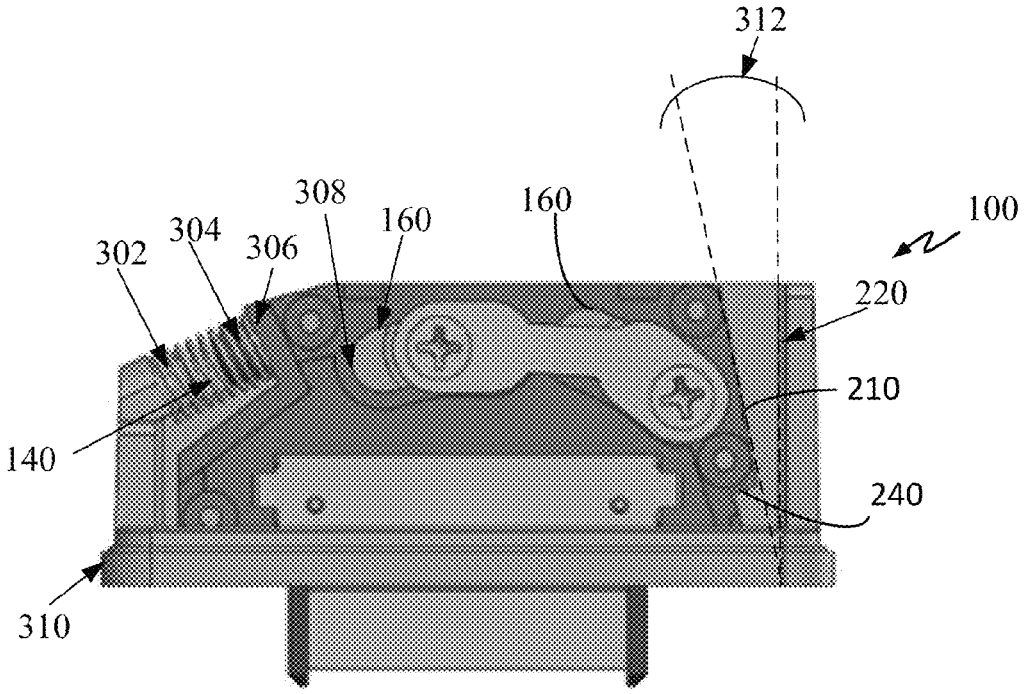
FIG. 3B illustrates a side view of an exemplary embodiment of the alignment apparatus in a closed position.

FIGS. 3A and 3B illustrate an exemplary embodiment of the alignment apparatus 100 in an open position and closed position respectively in more detail. Referring to FIG. 3A, the spring 140 is shown attached to a spring attachment plate 302 of the pivot mounting member 110 and to a spring insert 304 of the connector retaining member 120. The spring 140 may include a compression spring, a torsion spring, a leaf spring, or any other type of suitable spring. In an embodiment, the k value or spring constant of the spring element 140 is selected such that the total force exerted during the compression state ranges from approximately 0.5 to 1.5 lbs. (approximately 2.22 to 6.67 newtons). A person of skill in the art would appreciate that this range is merely illustrative in nature, and any other suitable spring force may be utilized as appropriate in a particular implementation for holding the connector retaining member 120 in an open position as described herein.

In an open position, the spring element 140 exerts force against a first side 306 of the connector retaining member 120 adjacent to the spring insert 304. The force of the spring 140 against the first side 306 slidably moves and rotates the connector retaining member 120 along the slots 160 until the connector retaining member 120 engages one or more of a slot wall 308, a surface 220 of pivot mounting member 110, or corner slot 240 (shown in FIG. 3B). For example, in one aspect, one or more of the tabs 170 engages the slot wall 308 (shown in FIG. 3B) of a slot 160 to prevent further movement of the connector retaining member 120. In another aspect, a surface 220 of the pivot mounting member 110 engages an angled side or surface 210 of the connector retaining member 120 to prevent further movement of the connector retaining member 120. In another aspect, a corner slot 240 formed in the connector retaining member 120 engages a corner piece (shown in FIG. 4) of the pivot mounting member 110 to prevent further movement of the connector retaining member 120. In another aspect, a combination of two or more of these components is implemented to prevent further movement of the connector retaining member 120. In another aspect, additional components or alternative components may also be implemented to prevent further movement of the connector retaining member 120.

In an embodiment, the one or more components are implemented to prevent further movement of the connector retaining member 120 when it reaches a predetermined angle with respect to the pivot mounting member 110. For example, in an embodiment, the angled surface 210 of the connector retaining member engages the surface 220 of the pivot mounting member 110 at the predetermined angle 180. The angled surface 210 has an approximately same angle 312 (shown in FIG. 3B) with respect to the surface 220 of the pivot mounting member 110 as the predetermined angle 180. In an embodiment, the angled surface 210 may be approximately 11 degrees. In another embodiment, the angled surface 210 may be in a range of approximately 6 degrees to 16 degrees. A person of skill in the art would appreciate that the size, shape, and/or angle of one or more of the slot 160, the angled surface 210, or the corner piece 240 may be adjusted to affect the desired predetermined angle 180 wherein the connector 130 is in a parallel position with the connecting mate 135 during installation.

In an embodiment, when the connector retaining member 120 reaches the predetermined angle 180 with respect to the pivot mounting member 110, a portion of the connector retaining member 120 protrudes from a frame 310 of the pivot mounting member 110. In other embodiments, the connector retaining member 120 may not protrude from the frame 310 of the pivot mounting member 110. For example, the size and/or shape of the connector 130 may be altered or the position of the connector retaining member 120 may be adjusted such that no portion of the connector retaining member 120 protrudes in the open position.

FIG. 3B illustrates an exemplary embodiment of the alignment apparatus 100 in a closed position. In the closed position, the accessory module 105 has completed its rotation with respect to the electronic device 125 and is attached to the electronic device 125 with the connector 130 fully engaged to the connector mate 135. The connector retaining member 120 is retracted into the alignment apparatus 100, and the connector retaining member 120 no longer protrudes from the pivot mounting member 110. The spring 140 is compressed and held in compression by the engagement of the connector 130 with the connecting mate 135.

Figure 4A:
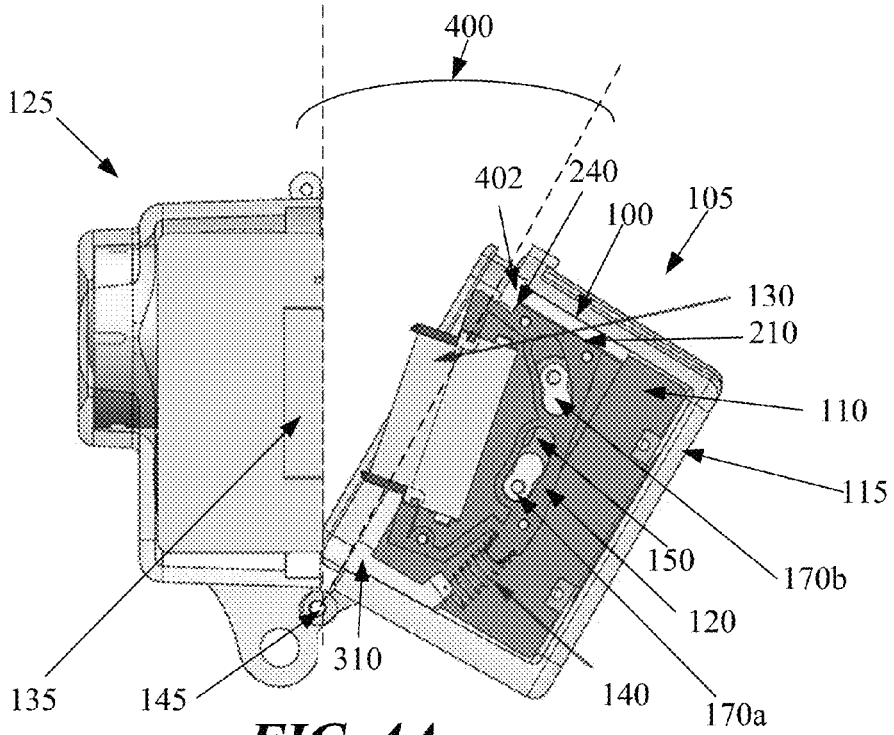
FIG. 4A illustrates a side view of an exemplary embodiment of the accessory module with the alignment apparatus in a fully open position at a first angle of rotation.

FIGS. 4A, 4B, 4C and 4D illustrate side views of an exemplary embodiment of the accessory module 105 including the alignment apparatus 100 at various angles of rotation with respect to the electronic device 125. In FIG. 4A, the accessory module 105 is moveably and rotatably attached to the electronic device 105 by the attachment mechanism 145. The alignment apparatus 100 is in a fully opened position at a first angle of rotation 400 of the accessory module 105 with respect to the electronic device 105. Though in a fully open position, the connector 130 is not yet aligned in a parallel position with the connecting mate 135 at this first angle of rotation 400.

As discussed with respect to FIG. 3, the spring 140 exerts force against the connector retaining member 120 to move and rotate it into an open position at the predetermined angle 180. One or more components prevent further movement of the connector retaining member 120 from the predetermined angle 180, including e.g. corner slot 240 formed in the connector retaining member 120. The corner slot 240 engages a corner piece 402 of the frame 310 of the pivot mounting member 110 to prevent further movement of the connector retaining member 120. In another aspect, one or more other components may prevent further movement of the connector retaining member 120, including, e.g. the slot wall 308, the surface 220 of pivot mounting member 110, etc. In another aspect, additional components or alternative components may also be implemented to prevent further movement of the connector retaining member 120.

Figure 4B:
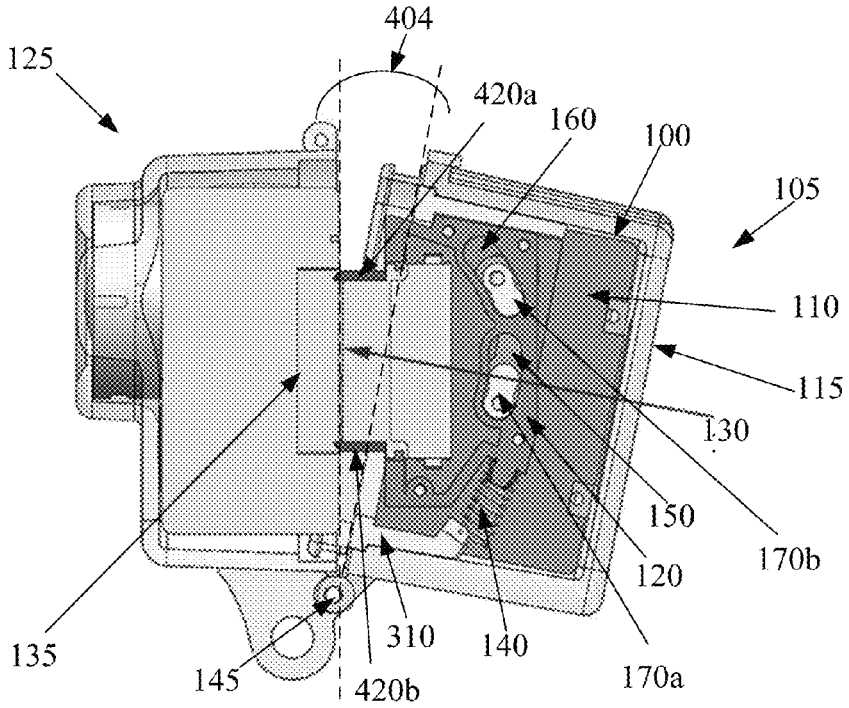
FIG. 4B illustrates a side view of an exemplary embodiment of the accessory module with the alignment apparatus in a fully open position at a second angle of rotation.

FIG. 4B illustrates an exemplary embodiment of the accessory module 105 including the alignment apparatus 100 at a second angle of rotation 404 with respect to the electronic device 125. In an embodiment, the connector 130 and the connecting mate 135 are initially contacting at least by this second angle of rotation 404. The alignment apparatus 100 is in a fully opened position at the second angle of rotation 404, and the connector 130 is now in an approximately parallel alignment with connecting mate 135.

To more easily engage and fully connect, the connector 130 and connecting mate 135 need to be in an approximately parallel position when initially contacting, e.g. prior to engagement or insertion of the connector 130 and the connecting mate 135. The alignment apparatus 100 is thus predesigned or adjusted such that the predetermined angle 180 is approximately equivalent to this second angle of rotation 404. The alignment apparatus 100 positions the connector 130 in an approximately parallel position with the connecting mate 135 at least approximately by this second angle of rotation 404 wherein the connector 130 and connecting mate are initially contacting. For example, when the predetermined angle is approximately 11 degrees, the connector 130 is in a parallel alignment with the connecting mate 135 when the vertical axis of the pivot mounting member 110 is at an approximately 11 degree angle of rotation 404 with respect to the vertical axis of the electronic device 125.

In another embodiment, the predetermined angle 180 is adjusted to position the connector 130 in a parallel position with the connecting mate 135 prior to the initial contact with the connecting mate 135. For example, when the connector 130 and connecting mate 135 initially contact at an angle of rotation of 11 degrees, the predetermined angle 180 of the connector 130 is configured at greater than 11 degrees, such as 11.25 or 11.50 degrees or in a range of approximately 11 to 13 degrees. The connector 130 and connecting mate 135 are in a parallel alignment prior to first contacting. The alignment apparatus 100 is thus configured or adjusted such that the predetermined angle 180 is greater than the angle of rotation wherein the connector 130 and connecting mate initially contact.

In an embodiment, one or more connector support walls 420*a*, 420*b* are attached on one or more upper and lower sides of the connector 130. The connector support walls 420*a*, 420*b* support the connector 130 and align the connector 130 during insertion with the connecting mate 135.

Figure 4C:
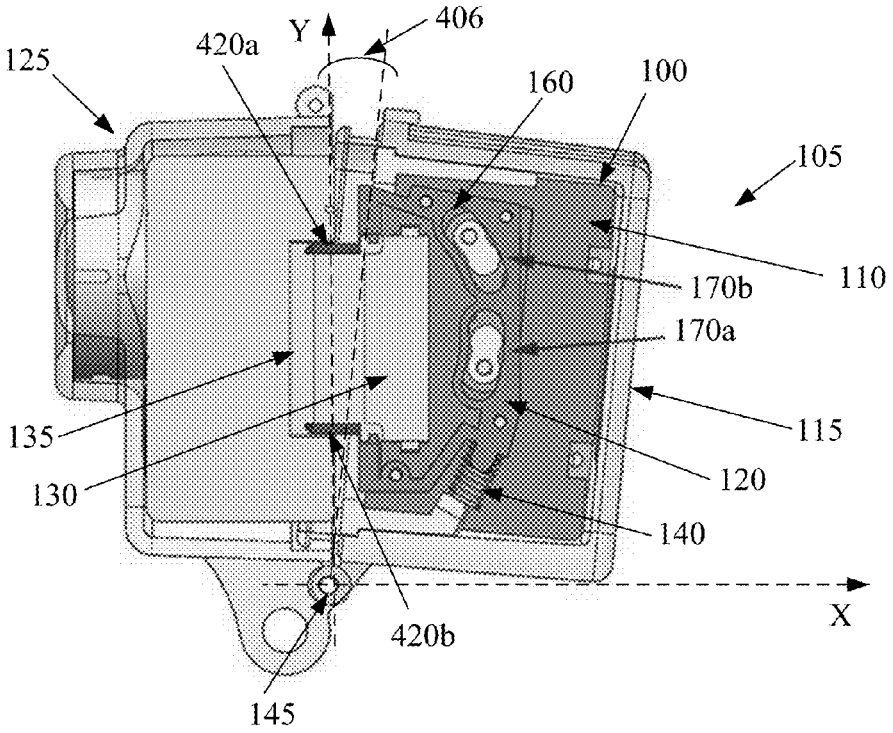
FIG. 4C illustrates a side view of an exemplary embodiment of the accessory module with the alignment apparatus in a partially closed position at a third angle of rotation.

FIG. 4C illustrates another exemplary embodiment of the accessory module 105 including the alignment apparatus 100 at a third angle of rotation 406 with respect to the electronic device 125. In an embodiment, the connector 130 and the connecting mate 135 are partially connected or engaged at this third angle of rotation 406 and exerting force on the connector retaining member 120. This force slides and rotates the connector retaining member 120 along the slots 160, guided by the tabs 170 and the retainer member 150, and compresses the spring 140.

In an embodiment, the curved shape and size of the slots 160 are designed to hold the connector retaining member 120, and so too the connector 130, in the approximately parallel position with respect to the connecting mate 135 while the accessory module 105 continues to rotate. For example, as the accessory module 105 rotates from the second angle of rotation 404 to the third angle of rotation 406 towards the electronic device 125, it moves in two directions, e.g. a horizontal X direction and a vertical Y direction. The connector retaining member 120 is configured to compensate for this movement from the second angle of rotation 404 at least in the vertical Y direction to maintain the connector 130 in an approximately parallel position with respect to the connecting mate 135. In an embodiment, the connector retaining member 120 is configured to compensate for the rotational movement in both the horizontal X direction and the vertical Y direction. For example, the connector retaining member is configured to move a distance in an opposite Y direction to maintain the connector in an approximately parallel position with respect to the connecting mate.

In one or more other embodiments, depending on the distance in the horizontal X direction necessary to fully engage the connector 130 and connecting mate 135, the connector retaining member 120 may compensate less than the full rotational movement in the X direction or alternatively, more than the full rotational movement in the X direction. For example, the connector retaining member is configured to move in an opposite X direction in a distance that is more than or less than the movement of the accessory module in the X direction.

Figure 4D:
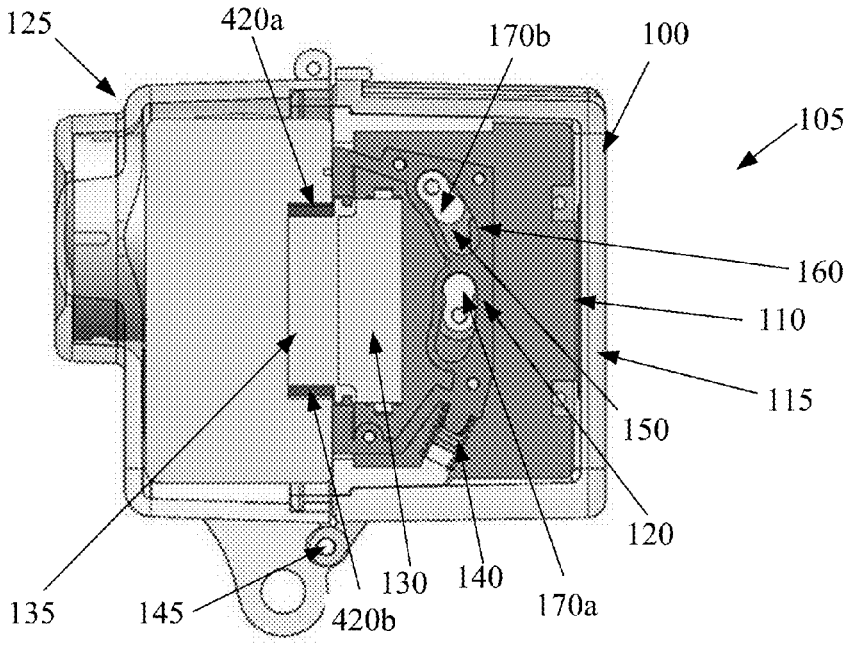
FIG. 4D illustrates a side view of an exemplary embodiment of the accessory module with the alignment apparatus in a fully closed position.

FIG. 4D illustrates another exemplary embodiment of the accessory module 105 including the alignment apparatus 100 in a fully closed position. The connector 130 and connecting mate 135 are fully connected or engaged and operable to communicate data and/or transfer power. The accessory module 105 has completed its rotation with respect to the electronic device 125 and is attached to the electronic device 125. The connector retaining member 120 is retracted into the alignment apparatus 100, and the portion of the connector retaining member 120 no longer protrudes from the pivot mounting member 110. The spring 140 is compressed and held in compression while the connector 130 is engaged with the connecting mate 135.

Figure 5A:
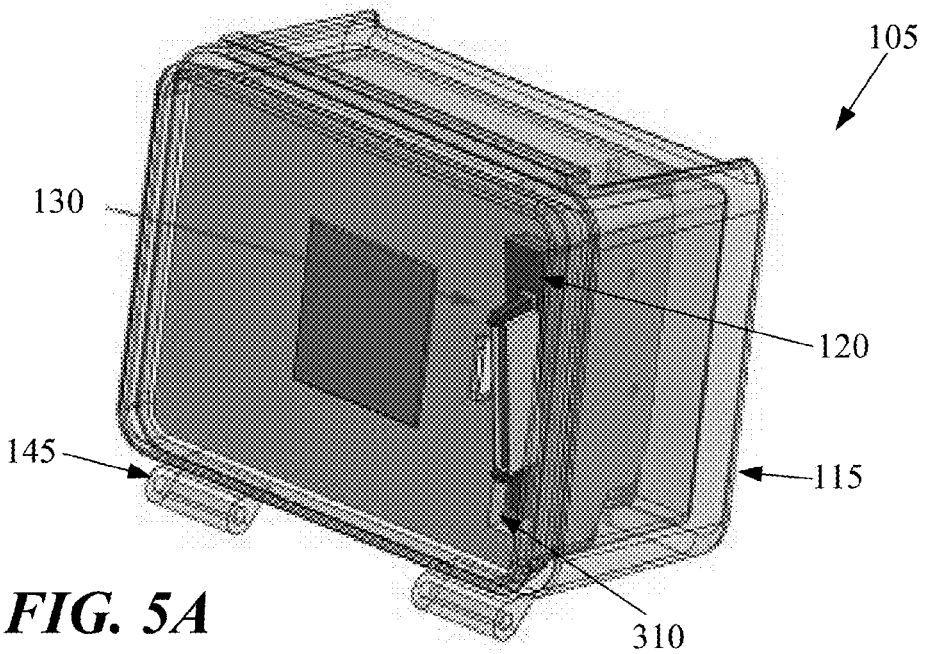
FIG. 5A illustrates an elevational view of an exemplary embodiment of the accessory module with the alignment apparatus in a fully open position.
Figure 5B:
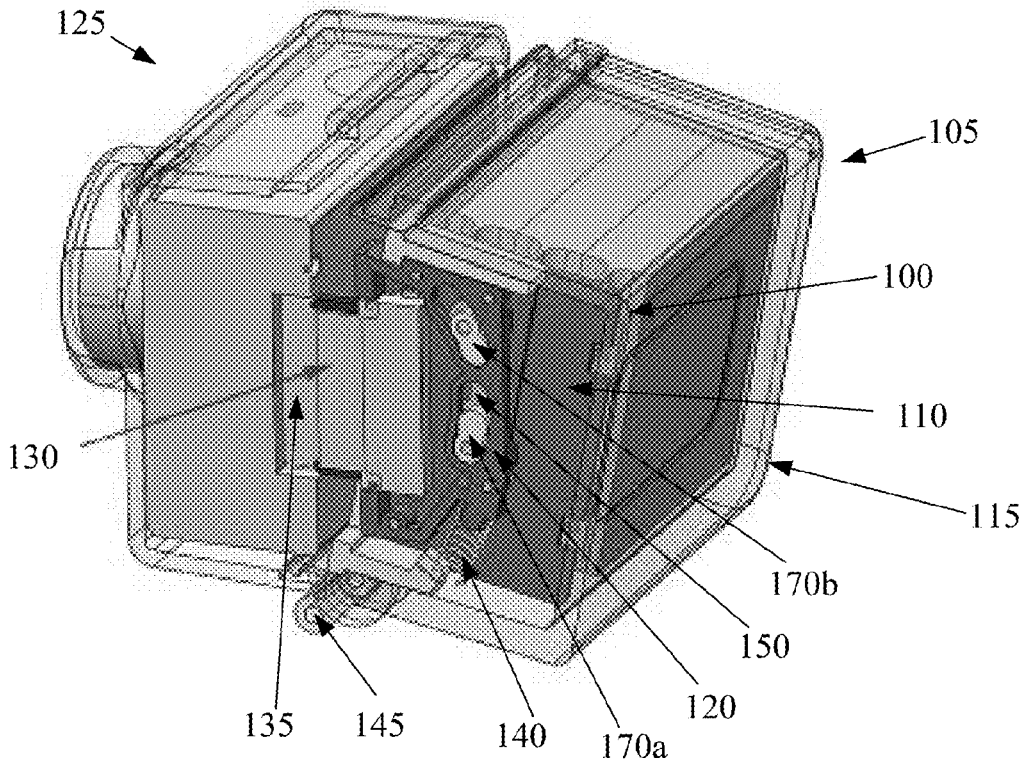
FIG. 5B illustrates an elevational view of an exemplary embodiment of the accessory module with the alignment apparatus in a fully open position at a first angle of rotation.

FIG. 5A illustrates an elevational view of an exemplary embodiment of the accessory module 105 including the alignment apparatus 100 in a fully open position. The connector 130 shown is a 30 pin to USB connector but may include other types of connectors for transferring data and/or power. In an embodiment shown in FIG. 5A, the connector 130 and the connector retaining member 120 protrude from the accessory module 105 at the predetermined angle 180 when in the fully open position. In other embodiments, the connector retaining member 120 may be offset from inner edge of the accessory module and not protrude from the accessory module at the predetermined angle. The size of the connector 130 may be adjusted to protrude sufficiently to fully engage the connecting mate 135 when accessory module 105 is fully rotated and engaged with the electronic device 105, e.g. when the angle of rotation is zero FIG. 5B illustrates an elevational view of an exemplary embodiment of the accessory module with the alignment apparatus in a fully open position at a first angle of rotation. At this first angle of rotation, the connector 130 and the connecting mate 135 are contacting without engagement or connection of the port. The alignment apparatus 100 is predesigned or adjusted such that the predetermined angle 180 is approximately the same as this angle of rotation. The alignment apparatus 100 thus positions the connector 130 in an approximately parallel position with the connecting mate 135 at this angle of rotation wherein the connector 130 and the connecting mate 135 are initially contacting without engagement or connection of the port. In another embodiment, the predetermined angle 180 is adjusted to position the connector 130 in a parallel position with the connecting mate 135 prior to an initial contact with the connecting mate 135. For example, when the connector 130 and connecting mate 135 first contact at an angle of rotation of 11 degrees, the predetermined angle 180 of the connector 130 is configured at greater than 11 degrees.

Figure 5C:
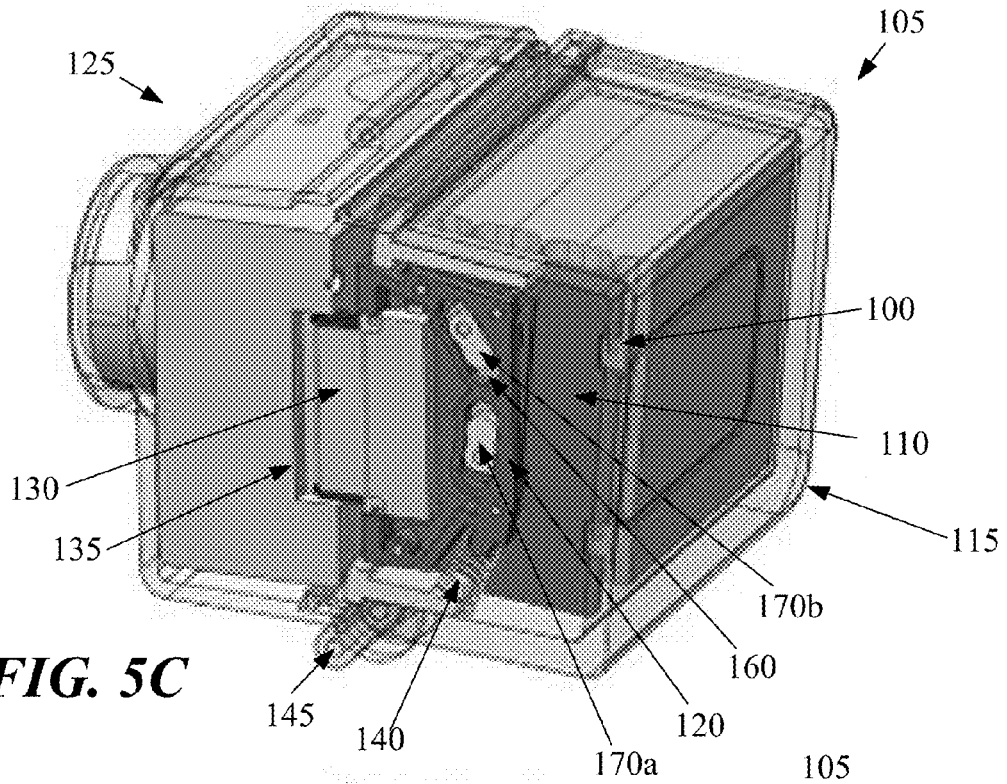
FIG. 5C illustrates an elevational view of an exemplary embodiment of the accessory module with the alignment apparatus in a partially closed position at a second angle of rotation.

FIG. 5C illustrates an elevational view of an exemplary embodiment of the accessory module with the alignment apparatus in a partially closed position at a second angle of rotation. In an embodiment, the connector 130 and the connecting mate 135 are partially connected or engaged at this second angle of rotation and exerting force on the connector retaining member 120. This force moves and rotates the connector retaining member 120 along the slots 160, guided by the tabs 170 and the retainer member 150, and compresses the spring 140. The curved shape and size of the slots 160 are configured to guide the connector retaining member 120, and so too the connector 130, to maintain an approximately parallel position with respect to the connecting mate 135 while the accessory module continues to rotate.

Figure 5D:
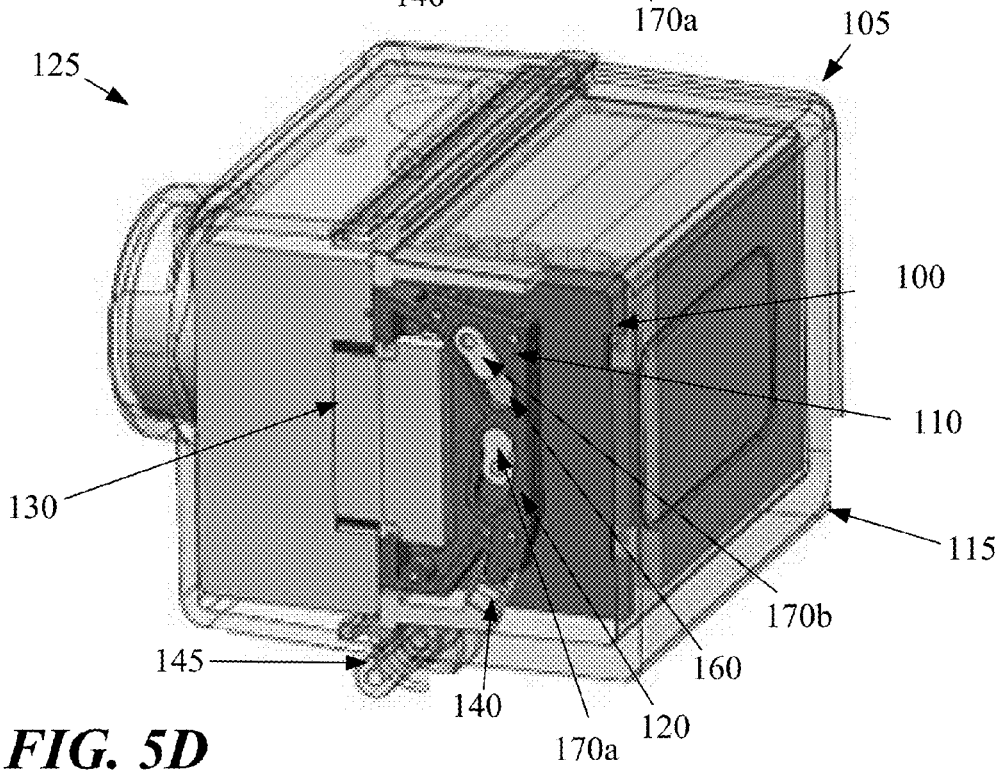
FIG. 5D illustrates an elevational view of an exemplary embodiment of the accessory module with the alignment apparatus in a fully closed position.

FIG. 5D illustrates an elevational view of an exemplary embodiment of the accessory module with the alignment apparatus in a fully closed position. The connector 130 and connecting mate 135 are fully connected or engaged and operable to communicate data and/or transfer power. The accessory module 105 has completed its rotation with respect to the electronic device 125 and/or is attached to the electronic device 125. The connector retaining member 120 is retracted into the alignment apparatus 100, and the portion of the connector retaining member 120 no longer protrudes from the pivot mounting member 110. The spring 140 is compressed and held in compression while the connector 130 is engaged with the connecting mate 135.

Figure 6:
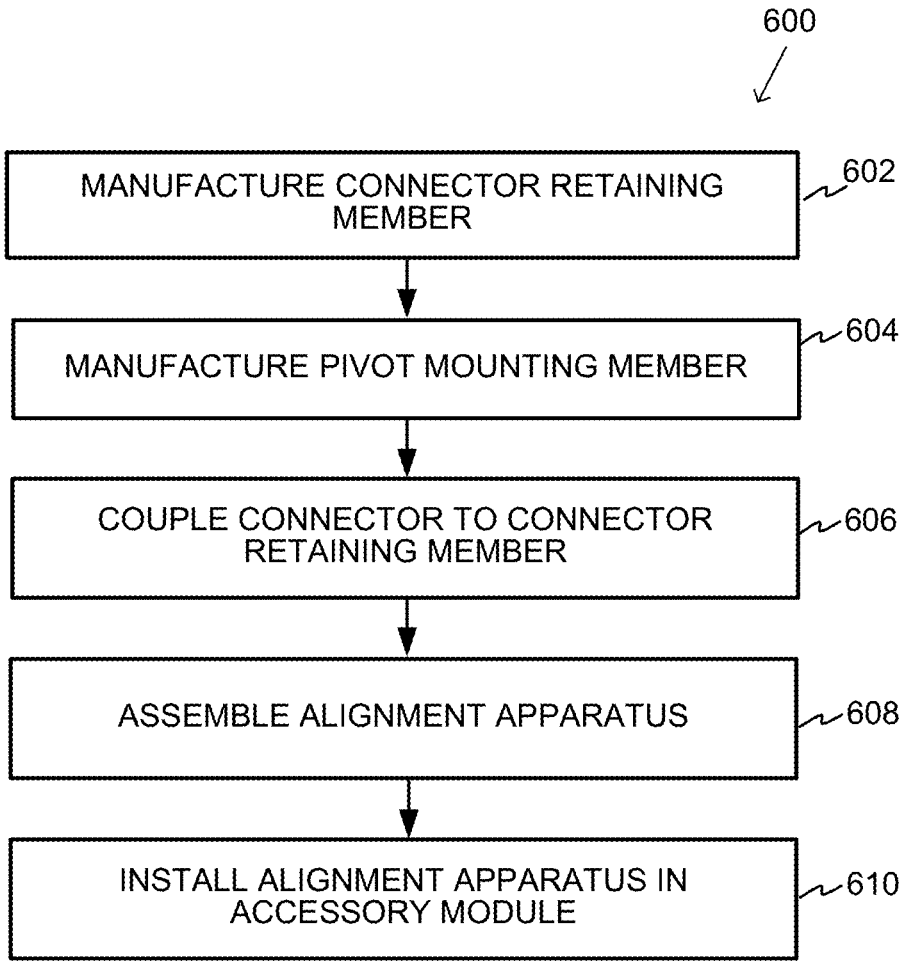
FIG. 6 illustrates a flow diagram of an exemplary embodiment of a method of manufacturing the alignment apparatus.

FIG. 6 illustrates a flow diagram of an exemplary embodiment of a method 600 of manufacturing the alignment apparatus 100. The connector retaining member 120 is manufactured from a plastic, metal, metal alloy or other suitable material using one or more manufacturing techniques, such as injection molding or extrusion molding at 602. The pivot mounting member 110 is also manufactured from a plastic material or other suitable material using one or more manufacturing techniques, such as injection molding or extrusion molding at 604. One or more of the other parts of the alignment apparatus 100, such as the tabs 170 and the retainer member 150, may also be manufactured from a plastic, metal, metal alloy or other suitable material using one or more manufacturing techniques. Alternatively, one or more of the parts may be sourced from a third party. At 606, the connector retaining member 120 is fixedly attached to the connector 130. The alignment apparatus 100 is fully or partially assembled at 608. The alignment apparatus 100 is installed in the accessory module 105 and any additional assembly completed at 610. Alternatively, in another embodiment, the connector may be fixedly attached to the connector retaining member 120 during installation of the alignment apparatus 100 in the accessory module 105.

Figure 7A:
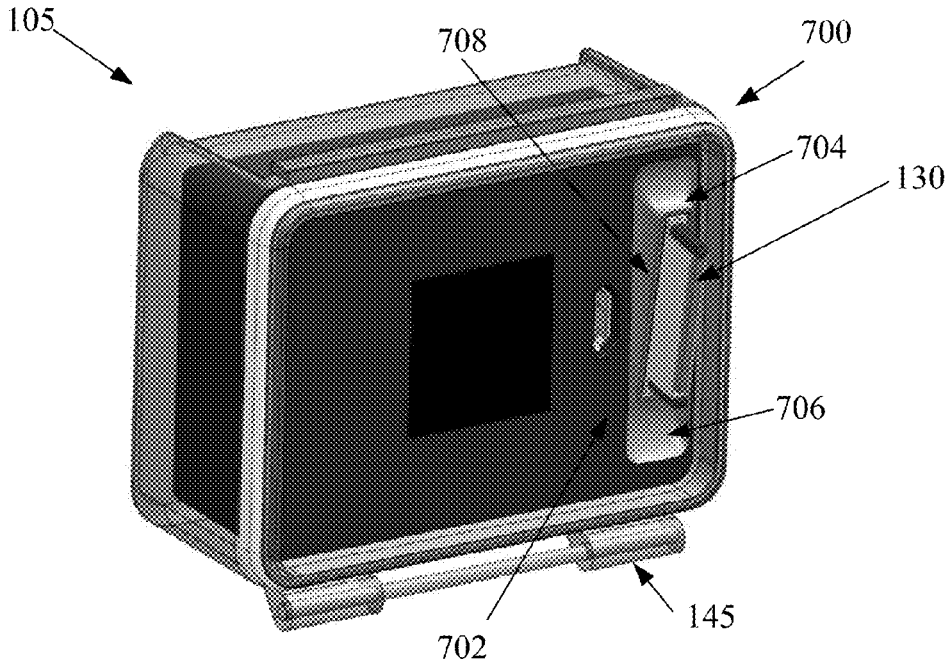
FIG. 7A illustrates an elevational view of the accessory module with another exemplary embodiment of an alignment apparatus in an open position.

FIG. 7A illustrates an elevational view of the accessory module 105 with another exemplary embodiment of an alignment apparatus 700 in an open position. The alignment apparatus 700 includes a retaining member 702 comprising of a pliable or elastic type material such as rubber that returns to its original shape after being stretched or deformed. In an embodiment, the retaining member 702 grips and supports the connector 130 in a first position at a predetermined angle such that the connector 130 is in an approximately parallel alignment to a connecting mate on an electronic device. The predetermined angle is approximately the same as the angle of rotation between the accessory module and the electronic device when the connector 130 and connecting mate are initially contacting or prior to contacting. The alignment apparatus 700 thus enables a parallel insertion of the connector 130 with the connecting mate during a rotating attachment of the accessory module to the electronic device. The predetermined angle 180 is adjusted to position the connector 130 in a parallel position with the connecting mate at or prior to an initial contact with the connecting mate 135. For example, when the connector 130 and connecting mate initially contact at an angle of rotation of 11 degrees, the predetermined angle 180 of the connector 130 with respect to the accessory module 105 is configured at approximately 11 degrees or in a range of 9 to 13 degrees.

In an embodiment, the retaining member 702 is formed to have rectangular shape to support the connector 130 at approximately the predetermined angle. An upper portion 704 of the retaining member 702 has a curved protruding profile that projects an upper portion of the connector 130 forward at a predetermined angle with respect to the accessory module 130. A lower portion 706 of the retaining member 702 has an inwardly curved profile that supports the lower power of the connector 130. Side portions 708 and 710 support the connector 130 in a vertical position. In one or more other embodiments, the retaining member 702 may include other shapes to support connectors with circular profiles or smaller profiles or other shapes and sizes.

During rotation of the accessory module 105, the retaining member 702 supports the connector 130 such that the connector 130 is in an approximately parallel alignment to the connecting mate on an electronic device at a predetermined angle of rotation between the electronic device and the accessory module 105. The retaining member 702 is configured to flex and bend to maintain the connector 130 in the approximately parallel alignment while the accessory module 105 continues to rotate in a counter clockwise direction towards the electronic device.

Figure 7B:
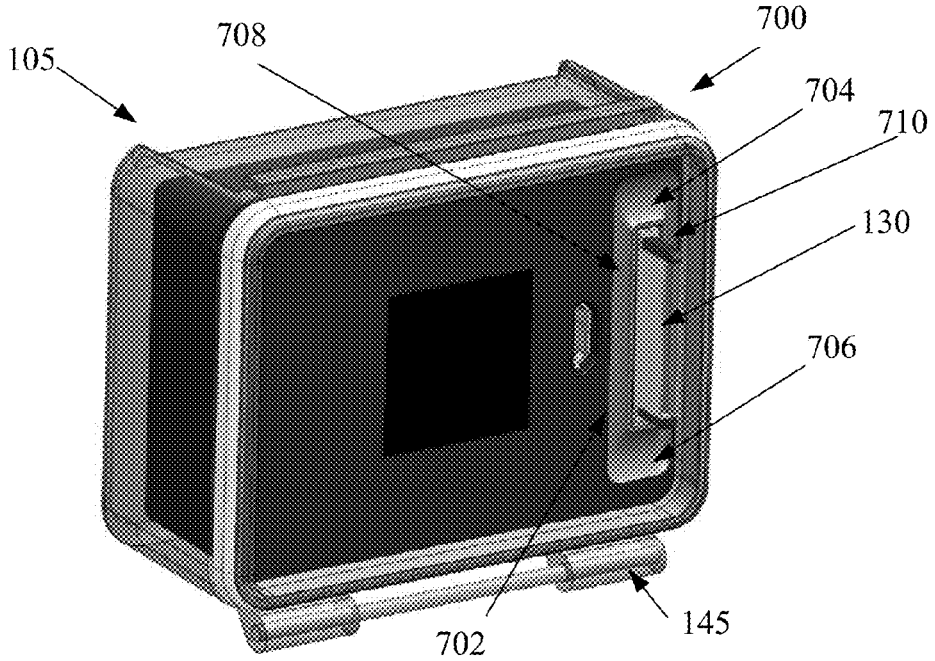
FIG. 7B illustrates an elevational view of the accessory module with the another exemplary embodiment of the alignment apparatus in a closed position.

FIG. 7B illustrates an elevational view of an exemplary embodiment of the accessory module with the alignment apparatus 300 in a closed position. The connector 130 is fully connected or engaged with a connecting mate and operable to communicate data and/or transfer power to an electronic device. The accessory module 105 has completed its rotation with respect to the electronic device and/or is attached to the electronic device. The flexible retaining member 702 is retracted or deformed into a closed position such that the connector 130 maintains its approximately parallel position to the accessory module 105.

Figure 8A:
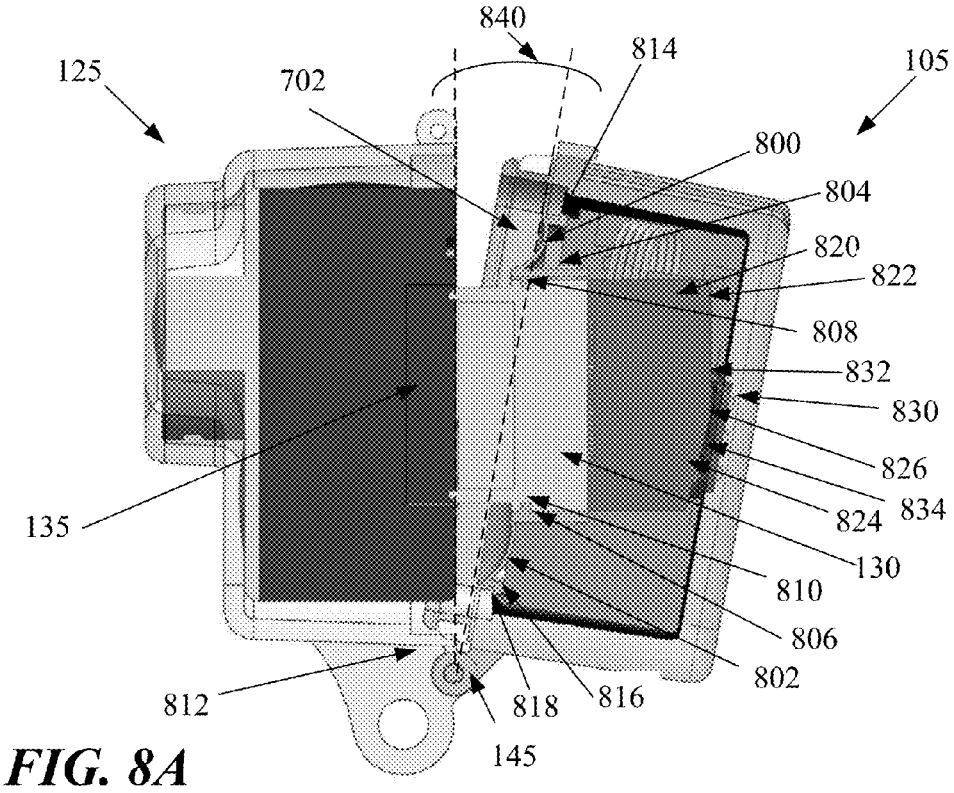
FIG. 8A illustrates a side view of the accessory module with the another exemplary embodiment of the alignment apparatus including a retaining member.

FIG. 8A illustrates a side view of the accessory module 105 with the alignment apparatus 700 including the retaining member 702. In FIG. 8A, the accessory module 105 is moveably and rotatably attached to the electronic device 105 by the attachment mechanism 145. The attachment mechanism 145 includes a hinge or pivot that is removably attachable to an attachment mate 812 on the electronic device 125. For example, the attachment mechanism 145 may include a hinge that attaches to a rod or clasp of the attachment mate 812. The attachment mechanism 145 is then operable to rotate or pivot with respect to the attachment mate 812 from an open position to a closed position. The rotating attachment 145 may include any other type of movable joint wherein the accessory module 105 rotates or pivots or swivels. For example, the rotating attachment may include a hinge, t-hinge, gate hinge, strap hinge, or another type of hinge, ball/socket joint or other movable joint. In the shown embodiment, the rotating attachment 145 is positioned on a bottom surface of the accessory module 105 though the rotating attachment 145 may also be positioned on a top or side surface of the accessory module 105.

In the embodiment shown in FIG. 8A, the alignment apparatus 700 is in open position at a first angle of rotation 840 of the accessory module 105 at or prior to an initial contact with the connecting mate 135 of the electronic device 125. The retaining member 702 supports and grips the connector 130 at a predetermined angle 842 that is adjusted to position the connector 130 in a parallel position with the connecting mate at or prior to the initial contact with the connecting mate 135 of the electronic device 105. In an embodiment, the retaining member 702 flexes to position and support the connector 130, in the approximately parallel position with respect to the connecting mate 135, while the accessory module 105 continues to rotate in a counter clockwise direction towards the electronic device 125.

The retaining member 702 includes an upper inner wall portion 804 and a lower inner wall portion 806 that are fixedly attached to the connector 130. For example, the upper and lower inner wall portions 804 and 806 may include protrusions 808 and 810, respectively, that frictionally engage upper and lower slots of the connector 130. In addition, or alternatively, the upper wall portion 804 and lower wall portion 806 may be adhesively attached to the connector 130 using one or more types of adhesives.

The retaining member 702 also includes an upper outer wall portion 814 and lower outer wall portion 816 that are fixedly attached to a frame 818 of the accessory module 105. For example, the upper and lower outer wall portions 814 and 816 may include a lip or other type of protrusion that frictionally engages the frame 818 of the accessory module 105. In addition, or alternatively, the upper and lower outer wall portions 814 and 816 may be adhesively attached to the the frame 818 using one or more types of adhesives.

The retaining member 702 also includes an upper flexible portion 800 positioned between the upper inner wall portion 804 and the upper outer wall portion 814. The upper flexible portion 800 includes a pliable or elastic type material such as rubber that is operable to stretch or deform between the upper inner wall portion 804 and the upper outer wall portion 814. In an embodiment, the upper flexible portion 800 includes a curved protruding profile that projects an upper portion of the connector 130 forward at a predetermined angle 842 (shown in FIG. 8B) with respect to the accessory module 130. A lower flexible portion 802 of the retaining member 702 is positioned between the lower inner wall portion 806 and the lower outer wall portion 816. The lower flexible portion 802 has an inwardly curved profile that supports the lower power of the connector 130. Side portions 708 and 710 (shown in FIGS. 7A and 7B) support the connector 130 in a vertical position and are fixedly attached to a frame 818 of the accessory module 105.

In addition, the connector 130 may be fixedly attached to a support member 820. The support member 820 engages a rotation member support 830 fixedly attached to the accessory module 105. The support member 820 assists to prevent further rotation or movement of the retaining member 720 in a counter clockwise direction further than approximately the predetermined angle 842. For example, the support member 820 includes an angled side 824 that is approximately at the predetermined angle 842 (shown in FIG. 8B). The angled side 824 engages the rotation support 826 to assist the retaining member 720 in supporting the connector 130 at the predetermined angle 842. The angled side 824 of the support member 829 also assists in preventing further movement of the support member 820 past the predetermined angle 842 and in supporting the connector 130 in a vertical position. For example, the rotation support 830 may include a protrusion or grip 832 that engages an apex 826 of the angled side 824 to prevent rotation greater than the predetermined angle 842. The apex 826 is formed at an intersection of the angled side 824 and a parallel side 822 of the support member 820. The support member 820 slides along the rotation support 830 from the angled side 824 in an open position to the parallel side 822 in a closed position.

In addition, the rotation support 830 may include an indentation or track 834 along which the support member 820 slides between the open and closed position. The support member 820 frictionally engages the indentation or track 820 to guide the support member 820 and help support the connector 130 to maintain a vertical position or vertical alignment with the connecting mate 135. In another aspect, additional components or alternative components may also be implemented to assist in preventing further rotation of the connector 130 from the predetermined angle 842 and/or assist in maintaining the connector 130 in a vertical position or vertical alignment with the connecting mate 135.

In an embodiment, the retaining member 720, either alone or with the support member 820, supports the connector 130, in an approximately parallel position with respect to the connecting mate 135 while the accessory module 105 rotates. For example, as the accessory module 105 rotates from the angle of rotation 840 towards the electronic device 125, it moves in two directions, e.g. a horizontal X direction and a vertical Y direction. The retaining member 720 is configured to flex and compensate for this movement to maintain the connector 130 in an approximately parallel position with respect to the connecting mate 135. In an embodiment, the retaining member 720 is configured to compensate for the rotational movement in both the horizontal X direction and the vertical Y direction. For example, the connector retaining member is configured to move a distance in an opposite Y direction and X direction as the rotating accessory module 105 to maintain the connector 130 in an approximately parallel position with respect to the connecting mate.

In one or more other embodiments, depending on the distance in the horizontal X direction necessary to fully engage the connector 130 and connecting mate 135, the retaining member 720 may compensate less than the full rotational movement in the X direction or alternatively, more than the full rotational movement in the X direction. For example, the connector retaining member is configured to move in an opposite X direction in a distance that is more than or less than the movement of the accessory module in the X direction.

Figure 8B:
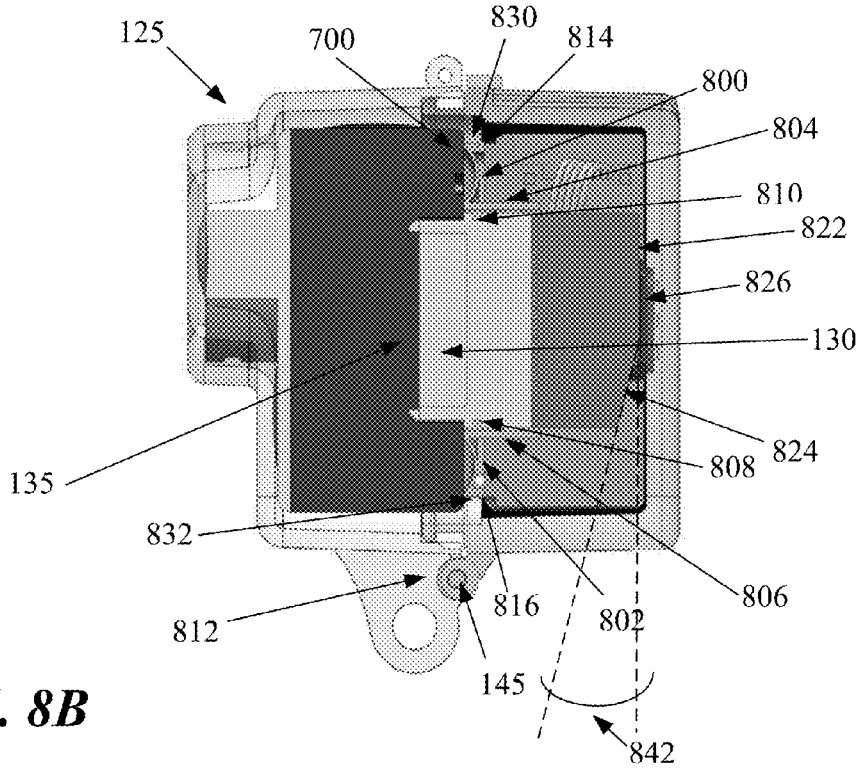
FIG. 8B illustrates a side view of the accessory module with the another exemplary embodiment of the accessory module 105 including the alignment apparatus in a closed position.

FIG. 8B illustrates a side view of another exemplary embodiment of the accessory module 105 including the alignment apparatus 700 in a fully closed position. The connector 130 and connecting mate 135 are fully connected or engaged and operable to communicate data and/or transfer power. The accessory module 105 has completed its rotation with respect to the electronic device 125 and is attached to the electronic device 125. The retaining member 702 is flexed and/or deformed such that the connector 130 remains in an approximately parallel position with respect to the connecting mate 135. For example, the upper flexible portion 800 of the retaining member 702 no longer protrudes further than the lower flexible portion 802. The retaining member 702 is compressed and held in compression while the connector 130 is engaged with the connecting mate 135. The support member 820 has slid along the rotation support 830 to a closed position wherein the parallel side 822 is engaged with the rotation support 830.

Figure 9A:
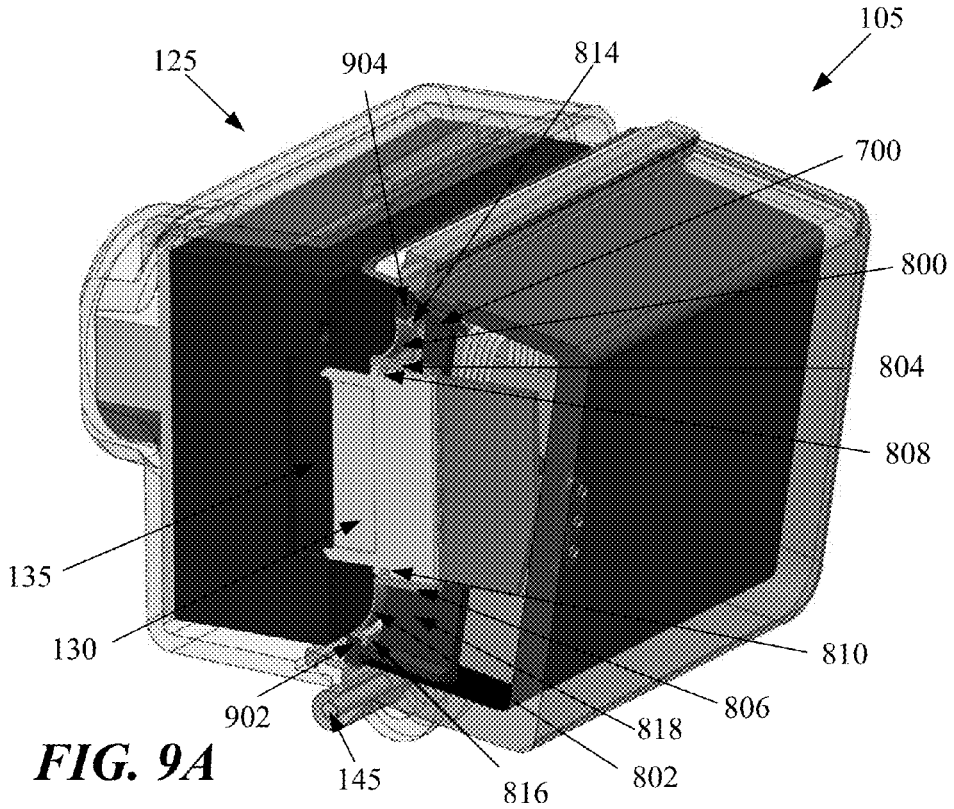
FIG. 9A illustrates an elevational view of the accessory module with the another exemplary embodiment of the alignment apparatus including the retaining member.

FIG. 9A illustrates an elevational view of the accessory module 105 with the alignment apparatus 700 including the retaining member 702. In the embodiment shown in FIG. 9A, the alignment apparatus 700 is in open position at a first angle of rotation 840 of the accessory module 105 at or prior to an initial contact with the connecting mate 135 of the electronic device 125. The retaining member 702 supports and grips the connector 130 at a predetermined angle 842 that is adjusted to position the connector 130 in a parallel position with the connecting mate at or prior to an initial contact with the connecting mate 135 of the electronic device 105. In an embodiment, the retaining member 702 flexes to position and support the connector 130, in the approximately parallel position with respect to the connecting mate 135, while the accessory module 105 continues to rotate.

The frame 818 supports the retaining member 702 within the accessory module 105. For example, the upper outer wall portion 814 of the retaining member is fixedly attached to an upper bar 904 of the frame 818. The upper bar 904 has a tee bar shape configured to fit a right angle of the upper outer wall portion 814. Tension from the retaining member 702 flexing against the upper bar 604 may hold the upper outer wall portion 814 against the upper bar 904. In addition, or alternatively, the upper wall portion 814 may be adhesively attached to the upper bar 904 using one or more types of adhesives.

The retaining member 702 also includes the lower outer wall portion 816 that is fixedly attached to the frame 818 of the accessory module 105. For example, the lower outer wall portion 816 of the retaining member is fixedly attached to the lower bar 902 of the frame 818. The lower bar 902 has a tee bar shape configured to fit a right angle of the lower outer wall portion 816. Tension from the retaining member 702 flexing against the lower bar 902 may hold the lower outer wall portion 816 against the lower bar 902. In addition, or alternatively, the lower outer wall portion 816 may be adhesively attached to the lower bar 902 using one or more types of adhesives.

Side portions 708 and 710 (shown in FIGS. 7A and 7B) of the retaining member 702 support the connector 130 in a vertical position and are fixedly attached to the frame 818 of the accessory module 105 as well using adhesive material or protrusions in the connector 130. In an embodiment, the retaining member 720 supports the connector 130, in an approximately parallel position with respect to the connecting mate 135 while the accessory module 105 rotates.

Figure 9B:
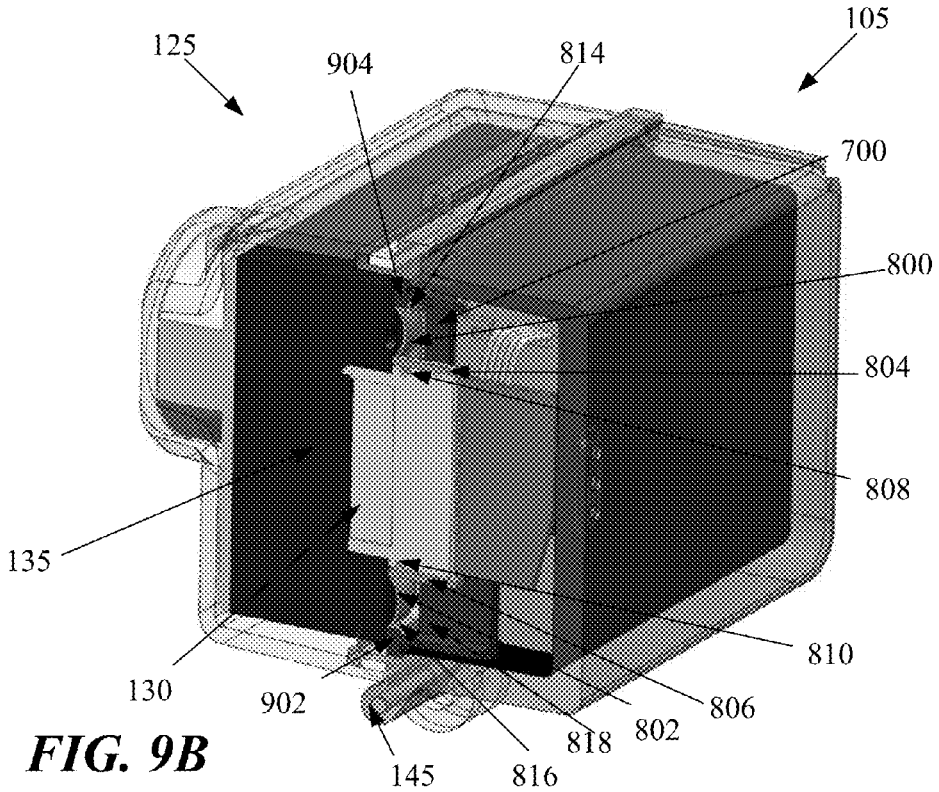
FIG. 9B illustrates a side view of the accessory module with the another exemplary embodiment of the alignment apparatus in a closed position.

FIG. 9B illustrates a side view of another exemplary embodiment of the accessory module 105 including the alignment apparatus 700 in a closed position. The connector 130 and connecting mate 135 are fully connected or engaged and operable to communicate data and/or transfer power. The accessory module 105 has completed its rotation with respect to the electronic device 125 and is attached to the electronic device 125. The retaining member 702 is flexed and/or deformed such that the connector 130 remains in an approximately parallel position with respect to the connecting mate 135.

When the accessory module 105 is detached and rotated in a clockwise direction, the retaining member 702 flexes back to its original shape as shown in FIG. 9A. The flexing of the retaining member 702 slides the support member 820 along the rotation support 830 to an open position wherein the angled side 824 is engaged with the rotation support 830.

Figure 10:
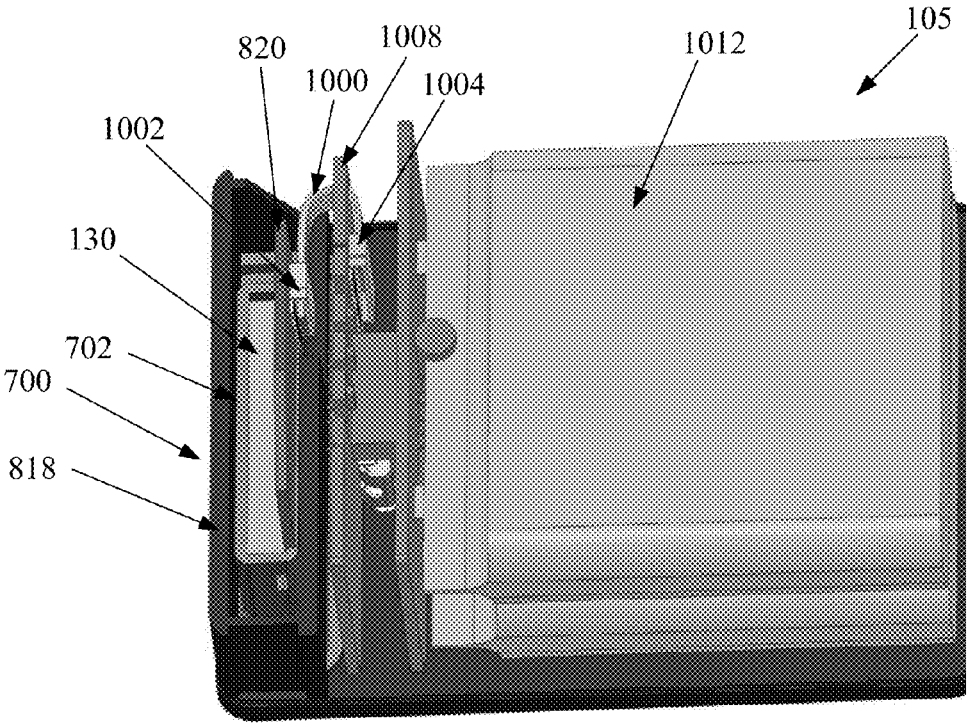
FIG. 10 illustrates an elevational view of another exemplary embodiment of the accessory module including the alignment apparatus.

FIG. 10 illustrates an elevational view of another exemplary embodiment of the accessory module 105 including the alignment apparatus 700. The alignment apparatus 700 includes the connector 130, flexible retaining member 702 and the frame 818. In an embodiment, the support member 820 includes a circuit board with a plurality of connections or pins that electrically couples the connector 130 to a ribbon cable 1000. The ribbon cable 1000 includes a first connector end 1002 electrically coupled to the support member 820 and a second connector end 1004 coupled to another circuit board 1008 or directly to a module 1012. In an embodiment, the module 1012 includes a battery or wireless device or other type of accessory. The ribbon cable 1000 provides flexibility in connecting the connector 130 to the module 1012 as the connector 130 rotates and/or moves during installation of the accessory module 105.

In one or more embodiments described herein, an accessory module is rotatably attached to an electronic device and includes an alignment apparatus and a connector. The alignment apparatus positions the connector at a predetermined angle such that the connector is in an approximately parallel alignment to a connecting mate on the electronic device. The predetermined angle is approximately the same as an angle of rotation between the accessory module and the electronic device when the connector and connecting mate are initially contacting or prior to contacting when the accessory module is rotating for attachment to the electronic device. The alignment apparatus thus enables a parallel insertion of the connector with the connecting mate during a rotating attachment of the accessory module to the electronic device.

Figure 11A:
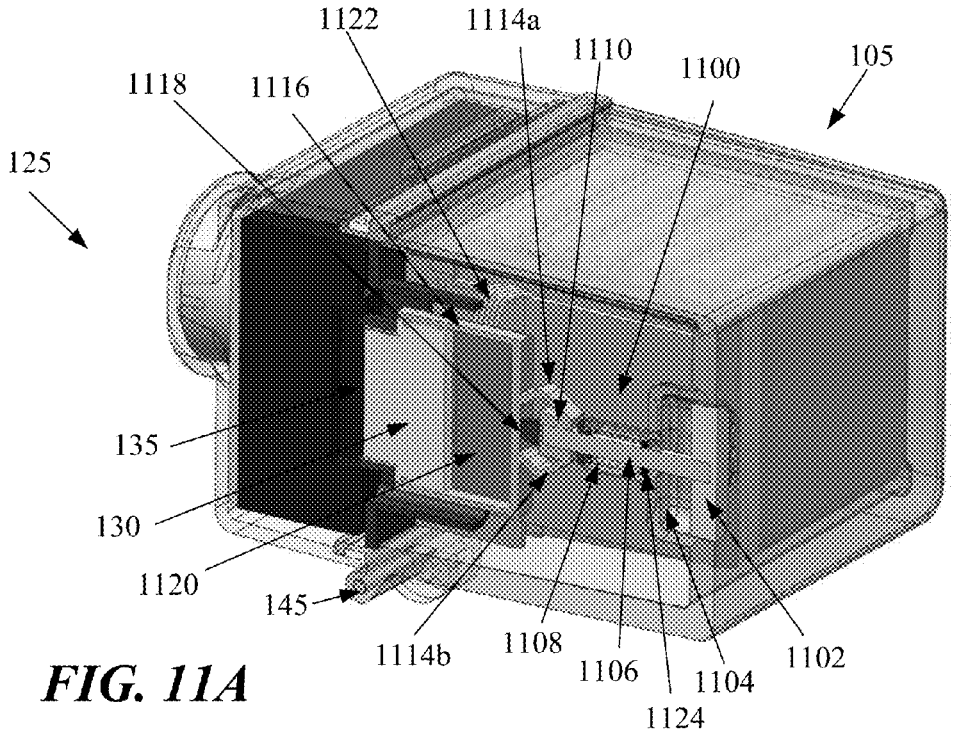
FIG. 11A illustrates an elevational view of an exemplary embodiment of the accessory module including a connecting plunger device in an open position.

FIG. 11A illustrates an elevational view of an exemplary embodiment of the accessory module 105 including a connecting plunger device 1100 in an open position. In this embodiment, the accessory module 105 is rotatably attached to the electronic device 125 by the attachment mechanism 145. The connecting plunger device 1100 is operable to engage or connect the connector 130 with the connecting mate 135 when the accessory module 105 is fully rotated and engaged with the electronic device 125.

The connecting plunger device 1100 includes a cap 1102 that is preferably secured within a recessed aperture 1104 formed in the accessory module 105. The cap 1102 is fixedly attached to a plunger arm 1106 that is positioned in and slides within a shaft 1108. The plunger arm 1106 is fixedly attached to a head structure 1110. The head structure 1110 includes a plurality of flexible side pieces 1114*a* and 1114*b* that protrude from the head structure and are attached to a connector frame 1116. The head structure 1110 may also include a flexible attachment 1118 that also attaches the head structure 1110 to the connector frame 1116. The connector 130 is fixedly attached to the connector frame 1116. The connector 130 may also be electrically coupled to a circuit board 1120 that includes a plurality of connections or pins that electrically couples the connector 130 to a ribbon cable 1122. The ribbon cable 1122 provides flexibility of movement for the connector 130 as the connector 130 moves for engagement with or detachment from the connecting mate 135.

In one aspect, the accessory module 105 is watertight and includes a water tight seal between the plunger arm 1106 and the recessed aperture 1104. For example, one or more washers 1124 may be implemented between the recessed aperture 1104 and the shaft 1108 to create the water tight seal.

Figure 11B:
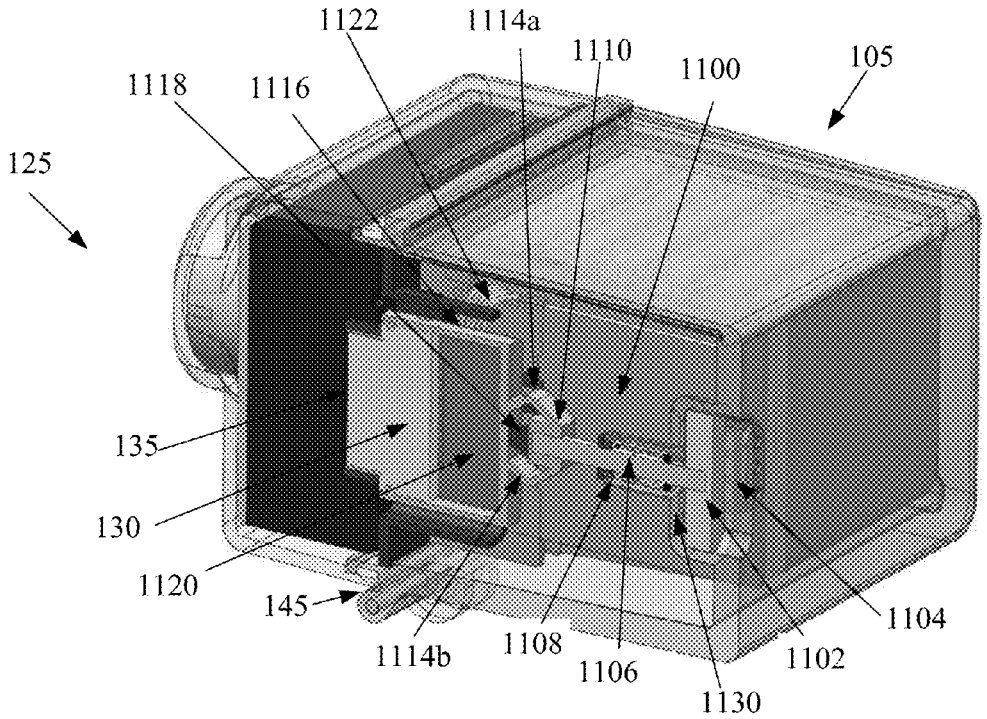
FIG. 11B illustrates an elevational view of an exemplary embodiment of the accessory module including the connecting plunger device in a closed position.

In FIG. 11A, the connecting plunger device 1100 is in an open position, and the connector 130 is not engaged or connected to the connecting mate 135. Referring now to FIG. 11B, FIG. 11B illustrates an elevational view of an exemplary embodiment of the accessory module 105 including the connecting plunger device 1100 in a closed position. In use, when the accessory module 105 is fully rotated and engaged with the electronic device 125, force is exerted on the cap 1102 to slide the plunger arm 1106 into the shaft and push the connector frame 1116 and thus the connector 130 towards the connecting mate 135. The connector 130 engages with the connecting mate 135 until the connector 130 and connecting mate 135 are fully connected or engaged and operable to communicate data and/or transfer power. In an embodiment, the aperture 1104 has an interior wall 1130 that engages the cap 1102 and prevents further movement of the plunger arm 1106 when the connector 130 is fully connected or engaged with the connecting mate 135.

Figure 12A:
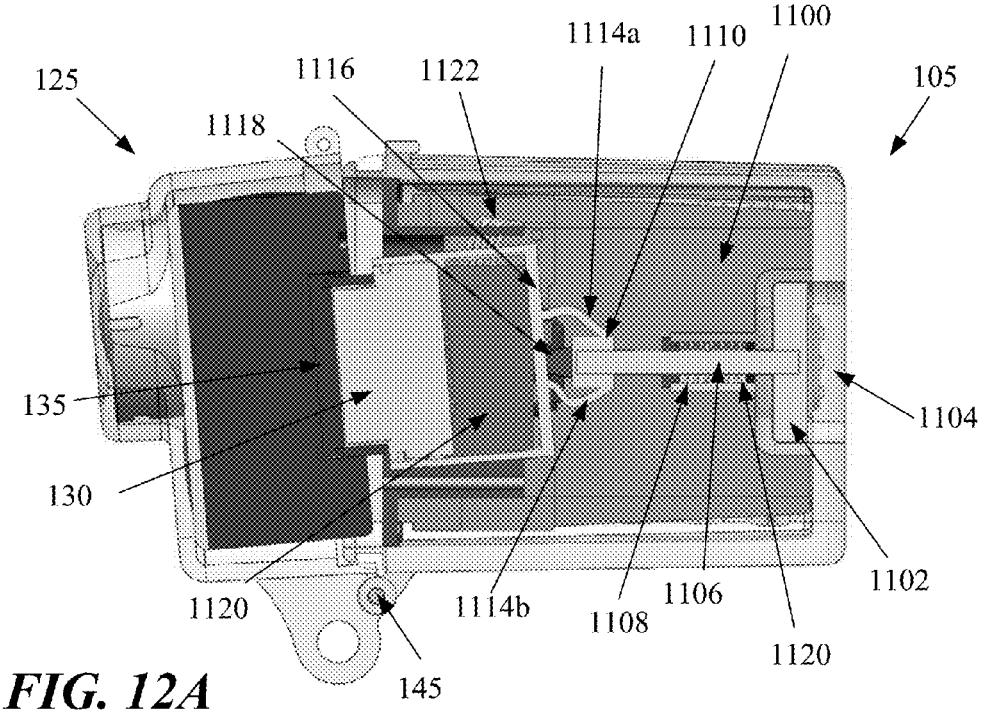
FIG. 12A illustrates a side view of an exemplary embodiment of the accessory module including the connecting plunger device in a partially open position.

FIG. 12A illustrates a side view of an exemplary embodiment of the accessory module 105 including the connecting plunger device 1100 in a partially open position. In one aspect, to detach the connector 130 from the connecting mate 135, a force may be exerted on the cap 1102 to pull the cap 1102 outwards towards the exterior of the aperture 1104. In response, the plunger arm 1106 pulls the connector frame 116 and thus the connector 130 in a direction opposite from the connecting mate 135 until the connector 130 disengages from the connecting mate 135. The connecting plunger device 1100 is then in an open position, and the accessory module 105 may be rotated in a clockwise direction to disengage or detach the accessory module 105 from the electronic device 135.

In another aspect, the accessory module 105 may be rotated in a clockwise direction to disengage or detach the accessory module 105 from the electronic device 135 while the connecting plunger device 1100 is still in a closed position. The rotation of the accessory module 105 with respect to the electronic device 125 exerts a torsional force on the connector 130 and the connector frame 1116. The torsional force strains the flexible side pieces 1114*a* and 1114*b* that protrude from the head structure that are attached to the connector frame 1116. For example, a first side piece 1114*a* is stretched by the rotation of the connector frame 1116 while a second side piece 1114*b* is flexed or bent by the rotation of the connector frame 1116.

The flexible side pieces 1114*a* and 1114*b* compensate for the rotation of the connector frame 1116 and prevent damage to the plunger arm 1106 as the connector 130 rotates and detaches from the connecting mate 135. In another aspect, a spring 1120 may be implemented within the shaft 1108 that exerts force against the cap 1102 outwards toward the aperture 104. As the rotation of the connector frame 1116 disengages the connector 130 from the connecting mate 135, the force exerted by the spring against the cap 1102 is sufficient to force the cap 1102 outwards into an open position. The connector 130 is then disengaged from the connecting mate 135.

Figure 12B:
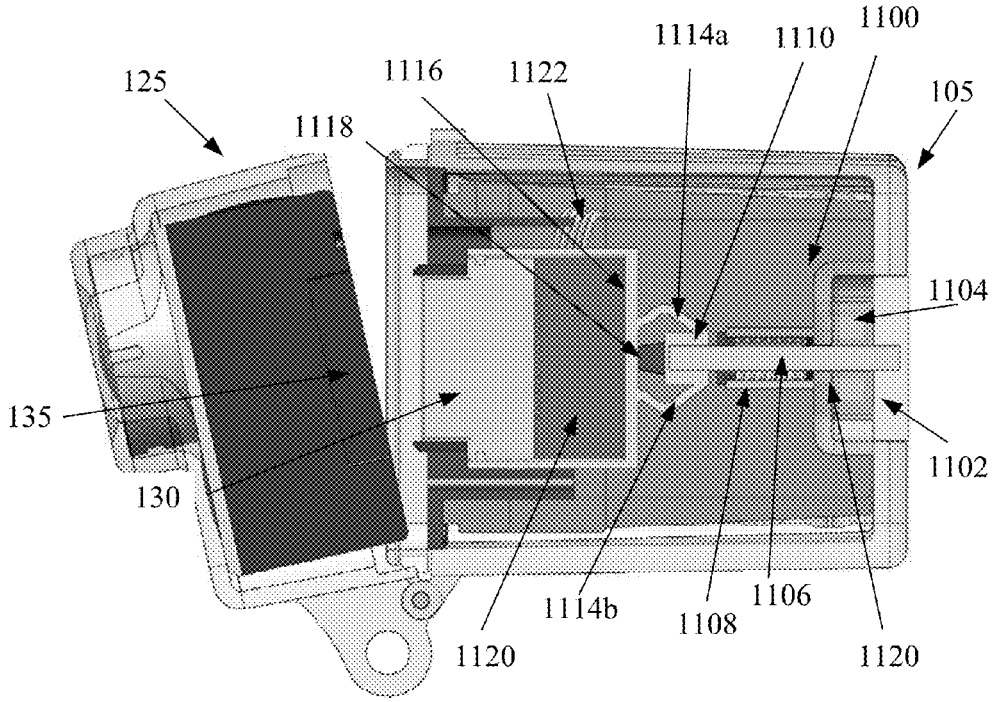
FIG. 12B illustrates a side view of an exemplary embodiment of the accessory module including the connecting plunger device in a fully open position.

FIG. 12B illustrates a side view of an exemplary embodiment of the accessory module 105 including the connecting plunger device 1100 in a fully open position. The accessory module 105 is rotated in a clockwise direction from the electronic device 125 and is fully detached from the electronic device 125. The flexible side pieces 1114*a* and 1114*b* have flexed back to their original shape as shown in FIG. 11A and FIG. 11B.

In one or more embodiments described herein, a connecting plunger device 1100 is operable to engage a connector 130 with the connecting mate 135 to attach or detach the connector 130 from the connecting mate when the accessory module 105 is fully rotated and engaged with the electronic device 125. In another aspect, the connecting plunger device 1100 may disengage the connector 130 from the connecting mate 135 as the accessory module is rotated to disengage or detach the accessory module 105 from the electronic device 135.

In the foregoing specification, certain representative aspects of the alignment apparatus have been described with reference to specific examples. Various modifications and changes may be made, however, without departing from the scope of the present invention as set forth in the claims. The specification and figures are illustrative, rather than restrictive, and modifications are intended to be included within the scope of the present invention. Accordingly, the scope of the embodiments should be determined by the claims and their legal equivalents rather than by merely the examples described herein. For example, the components and/or elements recited in any apparatus claims may be assembled or otherwise operationally configured in a variety of permutations and are accordingly not limited to the specific configuration recited in the specification.

Furthermore, certain benefits, other advantages and solutions to problems have been described above with regard to particular embodiments; however, any benefit, advantage, solution to a problem, or any element that may cause any particular benefit, advantage, or solution to occur or to become more pronounced are not to be construed as critical, required, or essential features or components of any or all the claims.

As used herein, the terms "comprise," "comprises," "comprising," "having," "including," "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition, or apparatus. Other combinations and/or modifications of the above-described structures, arrangements, applications, proportions, elements, materials, or components used in the practice of the present invention, in addition to those not specifically recited, may be varied or otherwise particularly adapted to specific environments, manufacturing specifications, design parameters, or other operating requirements without departing from the general principles of the same.

Moreover, reference to an element in the singular is not intended to mean "one and only one" unless specifically so stated, but rather "one or more." Unless specifically stated otherwise, the term "some" refers to one or more. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112(f), unless the element is expressly recited using the phrase "means for" or, in the case of a method claim, the element is recited using the phrase "step for."

In the context of the present specification, when an element is referred to as being "on" another element, it can be directly on the other element or be indirectly on the other element with one or more intervening elements interposed there between. Also, in the context of the present specification, when an element is referred to as being "connected" or "coupled" or "attached" to another element, it can be directly connected or coupled or attached to the other element or be indirectly connected or coupled or attached to the other element with one or more intervening elements interposed there between.

In the following description, certain terminology is used to describe certain features of one or more embodiments. As may be used herein, the terms "substantially" and "approximately" provides an industry-accepted tolerance for its corresponding term and/or relativity between items. The term "slot" or "groove" or "opening" may refer to any opening formed in a structure and/or component or a hollowed-out place in a structure and/or component, including apertures, bores, cavities, chambers, grooves, notches, passages, recesses, slits, wells and slots. The term "protrusion" may refer to a detent, a catch, or any other suitable object or part projecting in an outward or upward manner from a structure and/or component. The term "attachment" may refer to a hook, clasp, carabiner, hinge, fastener, or any other type of device or method that may be used for attaching items together.

Also, it is noted that the embodiments may be described as a process that is depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a function, a procedure, a subroutine, a subprogram, etc. When a process corresponds to a function, its termination corresponds to a return of the function to the calling function or the main function.

What is claimed is:

1. A device, comprising:

an attachment mechanism for rotatably attaching the device to another device;

a connector configured to engage a connector mate of the another device; and an alignment apparatus attached to the connector, wherein:

the attachment mechanism is configured to transition the device between an opened position during which the connector is not engaged with the connector mate and a closed position during which the connector is at least partially engaged with the connector mate, and the alignment apparatus positions the connector at a non-perpendicular angle with respect to the device when the device is in the opened position, to thereby position the connector at an approximately parallel position with respect to the connecting mate on the another device at a predetermined angle of rotation between the device and the another device.

2. The device of claim 1, wherein the connector retaining member comprises:

a flexible retaining member that supports the connector at the approximately parallel position with respect to the connecting mate on the another device at the predetermined angle of rotation between the device and the another device, wherein the flexible retaining member flexes to maintain the connector at the approximately parallel position with respect to the connecting mate as the device and the another device rotate to a closed position.

3. The device of claim 1, wherein the alignment apparatus comprises:

a pivot mounting member;

a connector retaining member movably coupled to the pivot mounting member, wherein the connector retaining member is rigidly coupled to the connector; and a spring element coupled to the pivot mounting member and the connector retaining member, wherein the spring element is configured to move the connector retaining member to the approximately parallel position with the connecting mate at the predetermined angle of rotation.

4. The device of claim 3, wherein the connector retaining member forms one or more slots, wherein the one or more slots are shaped to guide the connector retaining member.

5. The device of claim 3, wherein the alignment apparatus further comprises a retainer plate for slidably coupling the connector retaining member to move along the one or more slots with respect to the pivot mounting member.

6. The device of claim 3, wherein the connector retaining member includes a surface slanted at the predetermined angle; and wherein the surface slanted at the predetermined angle is configured to engage a surface of the pivot mounting member and position the connector retaining member at the approximately parallel position with the connecting mate at the predetermined angle of rotation.

7. An accessory module, comprising:

a rotating attachment configured to rotatably attach the accessory module to an electronic device; and an alignment apparatus, comprising:

a connector;

a retaining member attached to the connector, wherein the retaining member is configured to maintain the connector in an approximately parallel position with respect to a connecting mate coupled to the electronic device during a rotating attachment of the accessory module to the electronic device; and a pivot mounting member rigidly coupled to the accessory module, wherein the retaining member comprises a connector retaining member slidably and rotatably coupled to the pivot mounting member and configured to move the connector with respect to the pivot mounting member to a predetermined angle that aligns the connector in the approximately parallel position with respect to the connecting mate coupled to the electronic device, and wherein the connector retaining member forms one or more slots and wherein one or more tabs are fixedly attached to the pivot mounting member and secured in the one or more slots.

8. The accessory module of claim 7, further comprising:

a spring element coupled to the pivot mounting member and the connector retaining member, wherein the spring element is configured to move the connector retaining member to the predetermined angle with respect to the pivot mounting member.

9. The accessory module of claim 7, wherein the one or more slots include a curved shape such that the connector retaining member is configured to slide and rotate along the one or more slots with respect to the pivot mounting member to maintain the connector in an approximately parallel position with the connecting mate as the accessory module rotates towards the electronic device.

10. The accessory module of claim 7, further comprising:

a connector retainer member coupled to the pivot mounting member and to the one or more tabs, wherein the connector retaining member is configured to rotate and slide with respect to the pivot mounting member along the one or more slots guided by the one or more tabs and the retainer member.

11. The accessory module of claim 10, wherein at least one of the one or more slots includes a curved shape such that the connector retaining member is configured to slide and rotate along the at least one of the one or more slots with respect to the pivot mounting member to maintain the connector in an approximately parallel position with the connecting mate as the accessory module rotates with respect to the electronic device.

12. The accessory module of claim 11, wherein the connector retaining member is configured to move the connector with respect to the pivot mounting member to the predetermined angle when the accessory module rotates to a predetermined angle of rotation with respect to the electronic device.

13. The accessory module of claim 12, wherein the connector retaining member is configured to rotate and slide along the one or more slots to maintain the connector in an approximately parallel position with respect to the connecting mate as the accessory module rotates between the predetermined angle of rotation and full engagement with the electronic device.

14. The accessory module of claim 12, wherein the predetermined angle and the predetermined angle of rotation are approximately equivalent.

15. The accessory module of claim 12, wherein the predetermined angle and the predetermined angle of rotation are in a range of approximately 6 degrees to 16 degrees.

16. The accessory module of claim 12, wherein the predetermined angle of rotation includes at least one of: an angle wherein the connector and the connecting mate are initially contacting or an angle wherein the connector and the connecting mate are prior to contacting.

17. The accessory module of claim 12, wherein the accessory module moves a distance in a horizontal X direction and a vertical Y direction as the accessory module rotates between the predetermined angle of rotation and full engagement with the electronic device; and wherein the connector retaining member is configured to move a distance in an opposite Y direction to maintain the connector in an approximately parallel position with respect to the connecting mate.

* * * * *